US009080573B2

(12) United States Patent
Welte et al.

(10) Patent No.: US 9,080,573 B2
(45) Date of Patent: Jul. 14, 2015

(54) COOLANT PUMP WHICH EXHIBITS AN ADJUSTABLE DELIVERY VOLUME

(75) Inventors: Claus Welte, Aulendorf (DE); Uwe Meinig, Bad Saulgau (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 472 days.

(21) Appl. No.: 13/396,806

(22) Filed: Feb. 15, 2012

(65) Prior Publication Data

US 2012/0204818 A1 Aug. 16, 2012

(51) Int. Cl.

| | |
|---|---|
| ***F01P 7/14*** | (2006.01) |
| ***F04D 15/00*** | (2006.01) |
| *F04D 13/02* | (2006.01) |
| *F04D 13/12* | (2006.01) |

(52) U.S. Cl.

CPC ..... *F04D 15/0038* (2013.01); *F04D 13/021* (2013.01); *F04D 13/12* (2013.01); *F04D 15/0027* (2013.01)

(58) Field of Classification Search

CPC ... F04D 13/021; F04D 13/12; F04D 15/0027; F04D 15/0038

USPC ..... 123/41.08

See application file for complete search history.

(56) References Cited

U.S. PATENT DOCUMENTS

| | | | | |
|---|---|---|---|---|
| 1,813,747 | A | 7/1931 | Kirgan | |
| 3,784,318 | A * | 1/1974 | Davis | 415/158 |
| 3,930,759 | A * | 1/1976 | Drutchas | 417/283 |
| 4,213,735 | A * | 7/1980 | Grennan | 415/21 |
| 4,828,455 | A * | 5/1989 | Kinbara et al. | 415/131 |
| 4,932,835 | A * | 6/1990 | Sorokes | 415/150 |
| 5,282,446 | A * | 2/1994 | Whitefield | 123/198 C |
| 5,364,914 | A * | 11/1994 | Choate et al. | 525/505 |

(Continued)

FOREIGN PATENT DOCUMENTS

| | | |
|---|---|---|
| CH | 133892 A | 6/1929 |
| CH | 508 831 A | 6/1971 |

(Continued)

OTHER PUBLICATIONS

German PTO Office Action for Application No. 10 2011 004 172.9 dated Sep. 8, 2011.

(Continued)

*Primary Examiner* — Hung Q Nguyen
*Assistant Examiner* — James Kim
(74) *Attorney, Agent, or Firm* — RatnerPrestia

(57) ABSTRACT

A coolant pump for delivering a coolant in a coolant circuit of a combustion engine, including: a housing; a drive shaft, rotatably mounted by the housing and rotationally driven by the combustion engine; a radial feed wheel, rotationally driven by the drive shaft, for delivering coolant from a radially internal inflow region into a radially more external outflow region; a setting structure, adjustable into different positions relative to the housing by control fluid, for adjusting a flow geometry which influences the delivery volume of the pump at a given rotational speed; a control valve for setting a pressure or volume flow of the control fluid which determines the position of the setting structure; and a servo pump, which is a rotary pump including at least one servo pump wheel and can be rotationally driven by the drive shaft, for delivering the control fluid to the control valve.

30 Claims, 10 Drawing Sheets

(56) References Cited

U.S. PATENT DOCUMENTS

| | | | | |
|---|---|---|---|---|
| 5,716,201 | A * | 2/1998 | Peck et al. | 418/30 |
| 6,669,439 | B2 * | 12/2003 | Kardasz et al. | 415/131 |
| 7,789,049 | B2 * | 9/2010 | Duley | 123/41.47 |
| 2010/0284832 | A1 * | 11/2010 | Schmidt et al. | 417/307 |
| 2010/0294216 | A1 * | 11/2010 | Keene | 123/41.44 |
| 2013/0034427 | A1 * | 2/2013 | Fournier et al. | 415/148 |
| 2014/0308115 | A1 * | 10/2014 | Popp et al. | 415/148 |
| 2014/0322042 | A1 * | 10/2014 | Durand | 417/319 |

FOREIGN PATENT DOCUMENTS

| | | | |
|---|---|---|---|
| DE | 199 01 123 | A1 | 7/2000 |
| DE | 10 2005 056 200 | A1 | 6/2007 |
| DE | 10 2007 019 263 | B3 | 6/2008 |
| DE | 10 2008 026 218 | A1 | 12/2009 |
| DE | 10 2008 027 157 | A1 | 12/2009 |
| EP | 2 455 615 | A2 | 5/2012 |
| EP | 2455615 | A2 * | 5/2012 |
| WO | WO 2009/138058 | A1 | 11/2009 |
| WO | WO 2009/143832 | A2 | 12/2009 |
| WO | WO 2010/028921 | A1 | 3/2010 |

OTHER PUBLICATIONS

EPO Search Report for Application No. EP 12 15 5665 mailed Mar. 1, 2013.

* cited by examiner

Figure 12
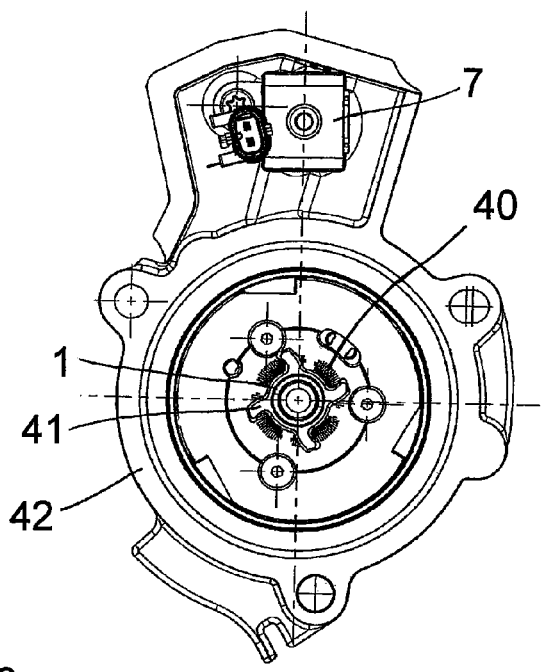
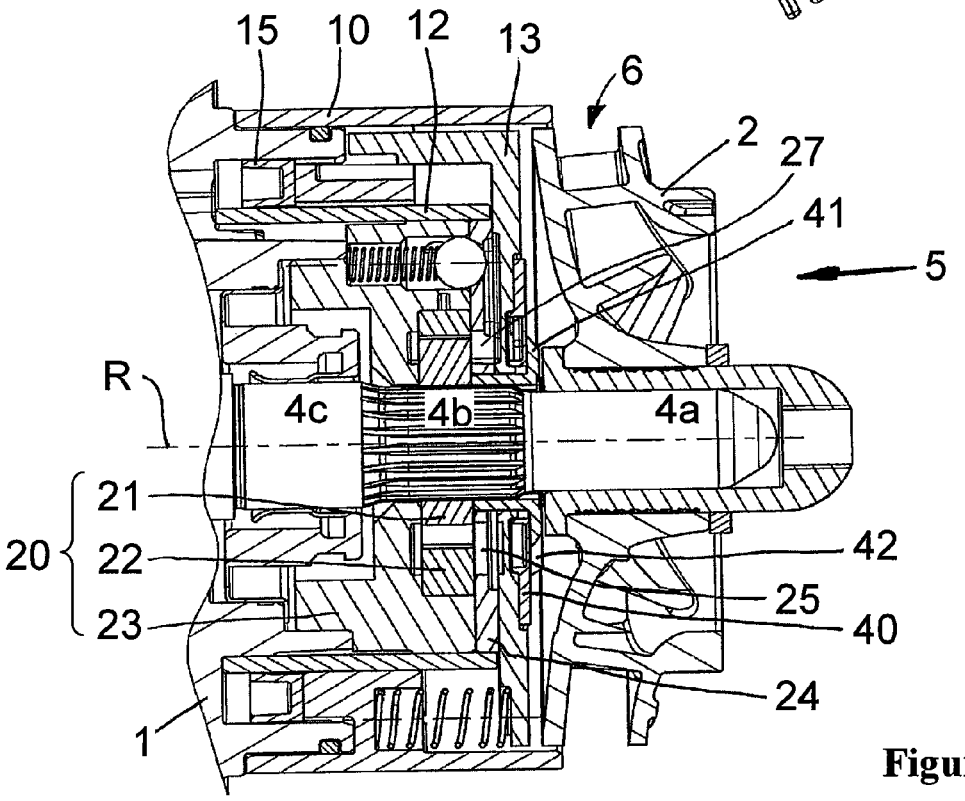
Figure 11

COOLANT PUMP WHICH EXHIBITS AN ADJUSTABLE DELIVERY VOLUME

CROSS REFERENCE TO RELATED APPLICATIONS

This application claims benefit of priority from German Patent Application No. 10 2011 004 172.9, filed Feb. 15, 2011. The contents of this application are incorporated herein by reference.

FIELD OF THE INVENTION

The invention relates to a coolant pump which can be adjusted in terms of its delivery volume, and to its use for cooling a combustion engine, preferably a drive motor of a motor vehicle.

BACKGROUND OF THE INVENTION

Developments in internal combustion engines for motor vehicles focus on reducing exhaust emissions and fuel consumption. One approach for reducing fuel consumption and emissions is to adapt the operation of the various ancillary units, which also include the coolant pump, more precisely to the requirements of the engine. These efforts are aimed at more rapidly heating the engine following a cold start and at reducing the operational output needed for the coolant pump, in particular at a high rotational speed of the engine. Mass-produced designs such as electrically driven coolant pumps and switchable friction roller drives make considering other alternatives seem worthwhile with regard to cost and reliability. The split ring slider represents an approach, which has been known for decades, for influencing the delivery characteristics of turbines as well as compressors and pumps having a radial design, wherein an annular slider which encompasses the feed wheel of the pump on the outer circumference is axially shifted, forming an annular gap, and the flow cross-section on the outer circumference of the feed wheel therefore varies. The annular slider acts as a shutter in the outflow region of the feed wheel. Different solutions for activating the split ring slider are known.

CH 133892 B, for example, describes activating the split ring slider by directly using the pressure difference which is built up by the pump itself. It describes not only axially adjustable split ring sliders but also a rotationally adjustable split ring slider. The pump is not however adapted to the cooling requirements of the drive motor of a vehicle.

U.S. Pat. No. 1,813,747 B describes a multi-stage pump system comprising a split ring slider for the first stage which is rotationally driven by an external toothed wheel motor via a shaft and an externally toothed spur wheel. The annular slider is also in a threaded engagement in which an axial movement is superimposed onto the rotational movement of the annular slider. The external toothed wheel motor is steam-driven. Activating the annular slider in this way is not however suitable for adjusting the delivery volume of coolant pumps in motor vehicles.

An annular slider which is activated by means of pressurized air is known from DE 2007 019 263 B3. Such pneumatic designs require a connection to a pressurized air source, which in many installation situations is problematic.

In a coolant pump such as is known from WO 2009/138058 A1, the split ring slider is hydraulically adjusted by means of an electromagnetically operated axial piston servo pump. Generating the reciprocating piston movements electromagnetically requires a significant amount of energy, the design of the servo pump is elaborate and the electromagnetic piston drive is temperature-sensitive.

WO 2009/143832 A2 discloses an adjustable coolant pump for motor vehicles which is driven via the ancillary unit belt drive of the engine. With the aim of being able to employ the pump at high ambient temperatures and in restricted installation spaces and to manufacture it in a simple and standardisable and therefore cost-effective way, wherein the pump should also require only a small drive output and should not need to be filled, free of air, at the factory and should exhibit a favorable fail-safe characteristic, it is proposed that the split ring slider be activated hydraulically by means of the coolant via an axial piston pump which is arranged in the housing of the coolant pump. A reciprocating axial movement is impressed on the axial piston pump via a swash plate attached on the rear side of the feed wheel, wherein the reciprocating frequency of the reciprocating axial movement increases with the drive rotational speed of the coolant pump. The hydraulic working pressure thus generated is guided, via a magnetic valve which is opened when there is no current, onto an annular piston which the annular slider is fixedly connected to axially. A restoring spring acts counter to the hydraulic working pressure. The coolant pump comprises a relatively large number of individual parts which have to be manufactured and assembled to a high level of precision. It also has a large axial design length, which limits the design scope for arranging the coolant pump in the available installation spaces. Presumably for this reason, the drive shaft of the feed wheel is rotationally mounted by means of a roll bearing unit which has a large spatial distance from the feed wheel of the pump. This creates a high torque, caused by radial forces, at the roll bearing unit. A bearing clearance at the roll bearing which increases over the service life of the coolant pump due to wear also limits the extent to which the feed wheel can be guided exactly, such that the danger of the feed wheel rubbing against the annular slider or the suction feed of the housing of the coolant pump increases over its service life. This effect has to be counteracted by comparatively large circumferential gaps, from which the effectiveness of the coolant pump suffers. Lastly, the sliding contact between the swash plate and the axial piston also makes great demands on the wear resistance of the material used for them. The swash plate also exerts a transverse force on the reciprocating axial piston.

In addition to the split ring sliders which encompass the rotor wheel on the outer circumference, other designs for varying the geometry of flow cross-sections or flow profiles with the aim of adjusting the delivery volume are also known. The split ring slider is replaced with another setting structure in these designs, depending on the nature of the change in the geometry.

DE 10 2005 056 200 A1 for instance proposes an adjustable inflow sleeve using which an entry cross-section which leads into the inflow region for the feed wheel can be adjusted. It is adjusted by means of a wax thermostat. Material expansions in the wax material which are dependent on the temperature of the coolant are converted into axial adjusting movements of the inflow sleeve which acts as a cross-section-altering inflow shutter in the inflow region. One's ability to control the delivery volume is however limited when using a wax thermostat. The flow in the inflow region is also disrupted, and the switching speed is comparatively low.

U.S. Pat. No. 4,828,455 B provides a guide plate as an adjusting structure which lies axially opposite the feed wheel and can vary the effective flow cross-section for the coolant via the diameter of the feed wheel by being axially adjusted. The guide plate is provided with breaches through which the vanes of the feed wheel protrude. If the guide plate is axially adjusted towards a base of the feed wheel, the axial width of the flow cross-section on the side of the guide plate which faces axially away from the feed wheel is increased between the inflow region and the outflow region. If the guide plate is adjusted away from the base of the feed wheel, the axial width of this effective flow cross-section is reduced. The delivery volume at a given rotational speed of the feed wheel is correspondingly increased and reduced. A wax thermostat is provided in the inflow region in order to activate the setting structure (the guide plate), wherein the coolant flows around the wax thermostat, and the temperature-induced material expansions in the wax material cause the guide plate to be axially adjusted.

DE 199 01 123 A1 discloses adjusting the delivery volume using an adjusting structure which is likewise formed, in a comparable way to U.S. Pat. No. 4,828,455 B, as a guide plate, i.e. as a setting structure which alters the axial width of the flow cross-section beyond the feed wheel. A wax thermostat is again used as the actuator. A setting structure is also disclosed which is arranged slightly downstream of the feed wheel in the outflow region and can alter a coolant exit cross-section in the housing.

WO 2010/028921 A1 also discloses adjusting the delivery volume by means of an axially movable guide plate. However, this setting structure is axially adjusted electromagnetically. The electromagnetic actuator is arranged on an axial end, facing away from the feed wheel, of a drive shaft which drives the feed wheel, and is connected to the setting structure via a plunger which extends axially through the hollow drive shaft.

Yet another type of adjusting structure is used in a coolant pump such as is known from DE 10 2008 027 157 A1, which is formed by adjustable guide vanes of a ring of guide vanes which encompasses the feed wheel and by a rotationally adjustable setting ring. The setting structure, i.e. the adjustable guide vanes and the setting ring, is adjusted by means of a lifting rod of an actuator, wherein it is mentioned that the actuator can be activated pneumatically, hydraulically, electrically or magnetically.

While DE 10 2008 027 157 A1 arranges the guide vanes such that they can be pivotally adjusted, U.S. Pat. No. 4,932,835 B discloses guide vanes which are arranged in the diffusor region of a centrifugal compressor and cannot be moved relative to each other and are rigidly connected to an axially adjustable annular cup. The setting structure formed by the annular cup and the axially projecting guide vanes can be axially adjusted by means of a hand wheel via a toothed wheel coupling, in order to vary the axial overlap between the feed wheel and the guide vanes.

BRIEF DESCRIPTION OF THE INVENTION

Aspects of the invention aim to provide a coolant pump which exhibits an adjustable delivery volume and is robust and compact, such that it can be arranged in tight installation spaces and operates reliably at the temperatures and other operational conditions which prevail in the cooling system of motor vehicle combustion engines, in particular drive motors, but which is simple in design and cost-effective. It is also advantageous if the coolant pump can be flexibly employed in its delivery characteristics, i.e. with regard to its delivery volume, in different designs of the coolant supply, despite being preferably driven in a fixed rotational speed relationship to the combustion engine.

The subject of the invention is a coolant pump for delivering a coolant in a coolant cycle, preferably a motor vehicle coolant cycle. The coolant pump can in particular be arranged in the coolant circuit of the drive motor, such as for example the drive motor of an internal combustion engine, in order to cool it. The coolant is preferably a cooling liquid, for example a water-based liquid. The invention relates to the coolant pump itself and to its use in a motor vehicle, in particular as a coolant pump for the drive motor of the vehicle. It can also advantageously be used to cool stationary combustion engines, for example for generating power.

The coolant pump comprises: a housing; a drive shaft which is mounted by the housing such that it can be rotated about a rotational axis; and a feed wheel, which can be rotationally driven by the drive shaft, for delivering the coolant. The coolant pump is embodied in a radial design, i.e. it is a radial or centrifugal pump. The feed wheel is correspondingly a radial feed wheel for delivering the coolant from a radially internal inflow region into a radially more external outflow region. The outflow region can in particular surround the radial feed wheel on the outer circumference, such that the coolant flows off from the radial feed wheel in the radial direction; in principle, however, the outflow region can also lie axially opposite a radially outer circumferential region of the feed wheel.

The coolant pump is preferably configured to be driven by the combustion engine. In simple preferred embodiments, the installed coolant pump can be driven in a fixed rotational speed relationship by the combustion engine. In principle, however, the possibility of the coolant pump being driven by another drive, for example a drive of its own, or by the combustion engine via a variable drive, should not be excluded. The coolant pump can comprise a drive member, preferably a drive wheel, which is non-rotationally connected to the drive shaft, for example by being formed in one piece with the drive shaft or preferably by being formed separately from the drive shaft and joined to it, secured against rotation, such that the rotational axis of the drive shaft is simultaneously also the rotational axis of the drive member.

The coolant pump also comprises a setting structure which serves to adjust a flow geometry, which influences the delivery volume of the pump at a given rotational speed, and which can be adjusted into different positions relative to the housing for this purpose. Within the context of this ability to be adjusted, the setting structure can preferably also be adjusted relative to the feed wheel. The flow geometry which can be altered by adjusting the setting structure can in particular be a transition cross-section through which the coolant flows from the flow region, which extends directly at the radial feed wheel and rotates with the feed wheel, into the outflow region of the housing. The flow geometry which can be varied by the setting structure can also be situated downstream of such a transition cross-section in the outflow region of the housing. The variable flow geometry can however also be a transition cross-section from the inflow region of the housing to the radial feed wheel or an entry cross-section into the inflow region, such as has likewise been mentioned with respect to the prior art. The variable flow geometry can also be the flow cross-section directly at the radial feed wheel, if the axial width of the flow cross-section which leads outwards at the radial feed wheel is embodied to be variable, as mentioned with respect to the prior art. In another embodiment, the flow geometry can be varied by means of a rotational impulse generator which is adjustably arranged in the inflow region. Such a setting structure impresses a rotational impulse on the coolant. The setting structure which is formed as a rotational impulse generator can be adjustable in such a way that in one adjusting position, it impresses a rotational impulse on the coolant which causes a rotational movement of the coolant in the rotational direction of the radial feed wheel, and in another adjusting position, it impresses a rotational impulse on the coolant counter to the rotational direction of the radial feed wheel. In all embodiments, the setting structure is a geometry variator, i.e. a flow geometry variator, which when adjusted varies the flow geometry for the coolant and consequently the delivery volume of the coolant pump in a specific way.

The setting structure is fluidically adjusted by means of a control fluid. The coolant pump comprises an actuator means for applying the control fluid to the setting structure. The actuator means comprises a control valve for setting a pressure or volume flow of the control fluid which determines the position of the setting structure. The control fluid is formed by the delivery medium—the coolant—itself. In order to generate the fluid energy required for adjusting the setting structure, the coolant pump comprises—in addition to the radial feed wheel—a servo pump, which can be driven by the drive shaft, for delivering the control fluid to the control valve. While the coolant can in principle be a cooling gas, it is however more preferably a liquid. Correspondingly, the setting structure is adjusted hydraulically in preferred embodiments.

In accordance with the invention, the servo pump is embodied as a rotary pump comprising at least one servo pump wheel. The servo pump is coupled to the drive shaft, such that it is likewise rotationally driven by the drive shaft when the radial feed wheel is rotationally driven. In preferred embodiments, the at least one servo pump wheel is connected, secured against rotation, to the drive shaft. It can in principle be formed in one piece with the drive shaft but is more preferably formed separately from the drive shaft and joined, secured against rotation, to the drive shaft. In such an embodiment, it can be connected to the drive shaft in a positive fit or in a frictional fit. The word "or" is understood here, as elsewhere, by the invention in its usual logical sense of "inclusive or", i.e. it encompasses the meaning of "and" and also the meaning of "either . . . or", unless only one of these two meanings can exclusively follow from the respectively specific context. In relation to a servo pump wheel which is joined to the drive shaft, this means that the servo pump wheel can be joined to the drive shaft in a positive fit only in a first embodiment, in a frictional fit only in a second embodiment, and in a positive fit and a frictional fit in a preferred third embodiment. In alternative embodiments, the at least one servo pump wheel can be connected to the drive shaft in a material fit instead or however in addition to a positive fit or frictional fit.

The combination of the servo pump or additional pump, for generating the control fluid energy required for adjusting, and a control valve for applying, in a controlled way, the fluid energy thus generated allows the application of the control fluid or fluid energy to be flexibly adapted to the requirements of one or more different consumers and thus allows the setting structure and consequently the delivery volume of the coolant pump to be adjusted under the conditions prevailing in the coolant circuit, such as in particular the coolant temperature and the temperature of adjacent units and machine parts, and is also hardly susceptible to dirt. Rotary pumps are more resistant to wear than the systems known in the prior art comprising axial piston pumps, since they continuously revolve at the rotational speed of the drive shaft. Displacement-type rotary pumps, such as are preferably employed, can be designed to be very small and compact, in particular axially short, for generating the required fluid energy. One substantial advantage is also the simple drive, since a wear-susceptible coupling such as is required for generating the reciprocating movement of axial piston pumps is omitted. The result is a compact and robust but simultaneously cost-effective actuator means in which there also does not have to be any trade-off with regard to the flexibility and precision of triggering the setting structure as compared to the known designs; on the contrary, the control valve enables the highest flexibility and precision.

The control valve can be connected by a signal line to a controller of the combustion engine—in the case of a vehicle engine, the engine controller—and can receive from this superordinated controller a control signal which determines the operation of the control valve. If the control valve is embodied as a switching valve, it is respectively moved or switched into one of its switching positions by means of the control signal. The control signal can expediently be generated in accordance with a measured temperature, in particular a temperature which is measured in the cooling circuit. A temperature sensor can be arranged at a representative location in the cooling circuit and its sensor output signal is fed to the controller which forms the control variable for the control valve from the sensor output signal and feeds it to the control valve. In one development, a temperature sensor is arranged at each of a plurality of representative locations in the cooling circuit and its sensor output signal is fed to the controller which forms the control variable for the control valve from the plurality of sensor output signals.

Instead of or in addition to the temperature, another representative control variable—for example, a rotational speed or load of the combustion engine or a mass throughflow or volume throughflow of the coolant—can also be adduced in order to form the control variable for the control valve. Regulating the position of the setting structure can be superimposed onto controlling on the basis of a measured temperature, rotational speed, load, a coolant throughflow or other relevant control variable. The coolant pump can then feature a position sensor which detects the axial position of the setting structure relative to the housing of the coolant pump or relative to the radial feed wheel. Instead, or in addition to a position sensor, a range sensor can also be provided which measures an axial distance which the setting structure assumes relative to an axial reference position in its respectively assumed adjusting position.

The term "controlling" is understood by the invention either in the sense of controlling without regulating or as controlling and regulating. If one or more sensor signals are fed back, for example a representative temperature signal from the cooling circuit or a position signal for the setting structure, the coolant pump is thus regulated with regard to the temperature or the adjusting position of the setting structure. Instead of regulating, the adjustment of the delivery volume can also constitute controlling without regulating, for example if the setting structure is merely triggered in accordance with a rotational speed or load of the combustion engine which for its part does not depend on the delivery volume of the coolant pump.

The control valve is preferably arranged on or in the housing of the coolant pump and is likewise preferably connected to the servo pump and the setting structure within the housing.

In simple embodiments, the setting structure and the actuator means can be configured to switch the setting structure only between axial end positions which are respectively predetermined by abutments, such that the setting structure assumes either an adjusting position which exhibits a maximum axial overlap with the outer circumference of the radial feed wheel or a setting position which exhibits a minimum axial overlap, but no intermediate position. In further developments, the setting structure and the actuator means can be configured to also set the setting structure to one or more discretely predetermined intermediate positions between the minimum-overlap adjusting position and the maximum-overlap adjusting position. In another further development, the actuator means can also be configured to set the setting structure to any intermediate position between two axial end positions, preferably in accordance with a spring force which restores the setting structure to one of the two extreme positions, such that the axial overlap can be adjusted continuously, i.e. non-incrementally.

The servo pump can be embodied particularly robustly as a toothed wheel pump. Embodying it as an internal toothed wheel pump is particularly favorable to the compactness of the coolant pump when viewed as a whole. The servo pump can however also be an external toothed wheel pump comprising an externally toothed first servo pump wheel and an externally toothed second servo pump wheel which is in toothed engagement with the first servo pump wheel, wherein one of the servo pump wheels is preferably rotationally fixed to the drive shaft. An internal toothed wheel pump comprises an externally toothed internal wheel and an internally toothed external wheel which is in toothed engagement with the internal wheel and has at least one tooth more than the internal wheel in order to form delivery cells with the internal wheel which increase in size on a low-pressure side and decrease in size again on a high-pressure side. If, as is preferred, the servo pump is such an internal toothed wheel pump, either the external wheel or preferably the internal wheel can be non-rotationally connected to the drive shaft. Although toothed wheel pumps, in particular internal toothed wheel pumps, are particularly advantageous for the purposes of the invention, the servo pump can also be embodied as a vane cell pump in alternative embodiments and comprise for example shifting or pivoting vanes or as applicable only one such vane. It can also be embodied as a roller cell pump.

The servo pump can be a positive-displacement-type pump, as described above. Instead, however, it can also advantageously be embodied as a fluid-flow machine, in particular a centrifugal pump. A side channel pump is one example of a preferred servo pump. Side channel pumps are also regarded as hybrid forms of displacement pumps and centrifugal pumps. One advantage of side channel pumps is that they can achieve high pressures when the delivered amount is low. As compared to toothed wheel pumps for example, they also promise a low susceptibility to wear which can be caused by dirt particles carried in the delivered fluid. This is advantageous in particular when the fluid delivered by the servo pump is directly formed by the coolant, which is increasingly laden with dirt particles in the course of its operational duration. Another advantage of side channel pumps is that they are self-priming and can also deliver liquid-gas mixtures without any problems and even separate them if desired and configured to.

In order to deliver the control fluid at high pressure, a multi-stage servo pump is provided in preferred embodiments, comprising a first stage and at least a second stage which is connected in series with the first stage, such that the control fluid is delivered from an outlet of the first stage to an inlet of the second stage. The inlet of the first stage is simultaneously also the inlet of the servo pump. If, as is preferred, the servo pump is only a two-stage pump, then the outlet of the second stage is also the outlet of the servo pump.

When embodied as a side channel pump, the servo pump comprises: a rotor wheel featuring rotor wheel cells, for example an impeller, which forms the at least one servo pump wheel; and at least one side channel which axially, i.e. laterally, faces said at least one rotor wheel and extends axially alongside the servo pump wheel in the circumferential direction around the rotational axis of the servo pump wheel. If the side channel pump comprises only one side channel, this side channel is connected to the inlet of the servo pump and, spaced in the circumferential direction, to the outlet of the servo pump. A side channel can also be provided laterally on each of the left and right of the at least one servo pump wheel. If the side channel pump is a multi-stage pump and comprises a first and at least another, second servo pump wheel, it is possible to provide only one side channel laterally facing the first servo pump wheel or one side channel on each of the two sides and to provide only one side channel laterally facing the second servo pump wheel or one side channel of each of the two sides. It is thus for example possible to provide only one side channel for the first servo pump wheel and one other side channel for the second servo pump wheel or to provide one side channel for one of the servo pump wheels and two side channels for the other of the servo pump wheels. Embodiments in which a side channel faces the first servo pump wheel on each of the left and right and a side channel also faces the second servo pump wheel on each of the left and right are preferred. If the pump is sequentially staged, it is preferred if the control fluid is delivered from one of the side channels of the first servo pump wheel to the other side channel of the first servo pump wheel and from there to one of the side channels of the second servo pump wheel and relayed via the other side channel of the second servo pump wheel towards the control valve.

The servo pump comprises an inlet on a low-pressure side and an outlet on a high-pressure side. The control fluid, i.e. the coolant, flows through the inlet into a delivery chamber of the servo pump in which the at least one servo pump wheel is rotatably arranged, and flows through the outlet of the servo pump towards the control valve. The inlet of the servo pump can advantageously be connected to the inflow region of the radial feed wheel, i.e. the servo pump can suction the control fluid from the inflow region. Instead or also additionally, however, the inlet of the servo pump can also be connected to the coolant circuit upstream of the inflow region. In order to keep dirt particles away from the inlet of the servo pump or to at least relieve a filter arranged in or at the inlet of the servo pump, the port or the inlet of the servo pump lie(s) within the centrifugal force field of the radial feed wheel in preferred embodiments.

The radial feed wheel can then comprise at least one aperture, preferably a plurality of apertures arranged in a distribution around the rotational axis, through which the coolant delivered by the radial feed wheel can flow to the inlet of the servo pump. The at least one aperture or the plurality of apertures form the port for the servo pump. In other preferred embodiments, a port is provided in the inflow region of the coolant pump, but within the centrifugal force field generated by the radial feed wheel and in a central inner region in relation to the centrifugal force field, wherein the coolant suctioned by the radial feed wheel is diverted within the centrifugal force field to the servo pump through the port. In such embodiments, the port is preferably arranged upstream of the radial feed wheel. It can be formed by one or more apertures. The port can advantageously be arranged on the drive shaft. The port can then be formed by one or more openings on a circumferential surface of the drive shaft. The port can be connected to the inlet of the servo pump through the drive shaft. Instead or additionally, a port which is central within the centrifugal force field can also be formed by one or more openings of the radial feed wheel which are near to the rotational axis, and the port can guide the coolant into the drive shaft where it can flow on towards the servo pump inlet. Instead of guiding the coolant through the drive shaft, it is possible—in particular in embodiments in which the radial feed wheel surrounds the drive shaft—to provide at least one fluid channel or preferably a plurality of fluid channels on the outer circumference of the drive shaft or on an inner circumference of the radial feed wheel which surrounds the drive shaft, for example in the form of one or more recesses, in particular grooves, on one of these two circumferences or also on both of the mutually facing circumferences. One or more recesses can then be formed on the inner circumference of the radial feed wheel which feed(s) onto the upstream end of the radial feed wheel, such that the coolant can flow in axially. Additionally or instead, the recess(es) can also feed onto the downstream end of the radial feed wheel. The recess(es) can in particular be one or more axial, linear recess(es). If one or more recess(es) is/are formed on the outer circumference of the drive shaft, these recess(es) preferably extend(s) beyond the upstream end of the radial feed wheel, in order to feed directly and centrally into the centrifugal force field. The dirt particles in the coolant are pushed outwards within the centrifugal force field, such that only coolant which is laden with dirt particles to a lesser extent than the coolant delivered by the radial feed wheel enters the port of the servo pump, which is central in relation to the centrifugal force field. The centrifugal force causes a certain separation. This counteracts wear on the servo pump caused by dirt particles. A filter comprising filter material can additionally be provided between the port and the actual inlet of the servo pump; such a filter can however be omitted in simple and not least for this reason preferred embodiments.

In particular in embodiments in which the coolant is diverted to the servo pump more externally within the centrifugal force field of the radial feed wheel, it is advantageous if the diverted coolant is guided via a filter comprising filter material to the servo pump wheel or the first servo pump wheel of a multi-stage servo pump. The filter can be arranged directly at the inlet of the servo pump. It is advantageously provided on or in the housing of the coolant pump.

In first embodiments comprising a filter, the filter can be connected to the drive shaft in a way which transmits torque, preferably secure against rotation. It is preferably connected directly to the drive shaft, for example by being non-rotationally positioned on the drive shaft. Instead, it can however also be non-rotationally connected to the drive shaft indirectly via another component which rotates with the drive shaft, such as for example the radial feed wheel or the servo pump wheel. Dirt particles are collected by the filter and transported outwards away from the filter by the centrifugal force which occurs when the pump is in operation, i.e. accelerated outwards away from the filter material of the filter.

In second embodiments comprising a filter, a cleaning means is assigned to the filter. The cleaning means and the filter are arranged such that when the radial feed wheel rotates, a relative rotational movement occurs between the cleaning means and the filter, in which the cleaning means cleans the filter of particles. Correspondingly, one of the cleaning means and the filter is directly or indirectly connected to the drive shaft in a way which transmits torque, preferably non-rotationally connected, and can be rotated relative to the other of the cleaning means and the filter. The other of the cleaning means and the filter is preferably arranged such that it cannot be moved relative to the housing of the coolant pump. The cleaning means can advantageously be arranged such that it sweeps over the filter during the relative rotational movement and thereby mechanically or fluidically cleans it.

The cleaning means can for example be embodied as a mechanical scraper. The scraper is arranged such that it scrapes over the filter material during the rotational movement relative to the preferably stationary filter and so removes dirt particles from the facing surface of the filter material. When embodied as a scraper, the cleaning means is preferably arranged upstream and directly in front of the filter. It can in particular be formed as an impeller.

In alternative variants, the cleaning means can also be arranged downstream, behind the filter. A downstream cleaning means can be embodied such that it cleans the filter fluidically. The control fluid delivered by the servo pump can be applied to the downstream rear side of the filter by means of a fluidic cleaning means. The control fluid is applied to the filter by means of the fluidic cleaning means counter to the outward flowing direction which leads to the servo pump, and the filter is therefore rinsed and cleaned in the opposite direction to the outward flowing direction. This can be realized by means of a blocking element which separates the high-pressure side from the cleaning means and only establishes a connection for such reverse-flow rinsing in operational states of the coolant pump in which the control fluid pumped by the servo pump is not needed for adjusting the setting structure. If, as is preferred, the cleaning means comprises an impeller featuring one or more vanes which always overlap(s) only a part of the surface of the filter material which the fluid can flow through, then such a blocking element can be omitted and control fluid of the high-pressure side of the servo pump can be constantly guided to the rear side of the filter. Coolant flows through the filter region which is not overlapped by the impeller at the respective moment during the relative rotation, towards the at least one servo pump wheel, and is thereby cleaned by means of the filter, while in the respectively overlapped filter region, control fluid of the high-pressure side of the servo pump simultaneously flows in the opposite direction through the vane or vanes and through the filter, rinsing and therefore cleaning the filter.

In one modification, a cleaning means which is arranged downstream of the filter and cleans fluidically can be arranged such that it cannot be moved or at least not rotated relative to the filter and configured to apply the control fluid delivered by the servo pump to the downstream rear side of the filter in operational states of the coolant pump in which the control fluid pumped by the servo pump is not needed for adjusting the setting structure. The control fluid is applied to the filter by means of such a fluidic cleaning means counter to the inflow direction leading to the servo pump and the filter is therefore rinsed and cleaned in the opposite direction to the inflow direction. A cleaning means which cannot be moved relative to the filter expediently comprises a blocking element which is arranged in a fluid connection which leads from the high-pressure side of the servo pump to the rear side of the filter, wherein said blocking element can block the fluid connection and open it in the operational states of the coolant pump in which the control fluid pumped by the servo pump is not needed for adjusting the setting structure.

A cleaning means which is arranged behind the filter can comprise an impeller featuring one or more vanes which is/are formed and arranged such that it/they sweep(s) over the rear side of the filter at a small distance during a relative rotational movement and thereby exert a pressure on the rear side of the filter which acts in said opposite direction and presses dirt particles out of the filter material of the filter in the opposite direction, away from the inlet of the servo pump. The filter can also be fluidically cleaned in this way. The impeller preferably does not then contact the filter. This cleaning means, which is based on hydrodynamically building up pressure through the relative rotational movement, can be combined with one of the cleaning means which are based on rinsing with the control fluid, such as are for example explained in the two directly preceding paragraphs.

The servo pump preferably comprises a servo pump housing of its own comprising a delivery chamber in which the at least one servo pump wheel—or, in embodiments with a plurality of servo pump wheels, the servo pump wheels which co-operate in the delivery engagement for the purpose of delivery—is/are rotatably accommodated. If the servo pump is an internal toothed wheel pump, the servo pump housing can in particular mount the external wheel, such that it can be rotated about its rotational axis, directly in a rotational sliding contact. The servo pump housing is preferably arranged in the housing of the coolant pump. It is advantageously arranged in the axial vicinity of the radial feed wheel.

It is advantageous if a lid of the housing of the coolant pump also forms a lid of the servo pump housing. Collective lidding can reduce the number of parts of the pump or an axial distance between the radial feed wheel and the servo pump wheel and thus the length of the pump. An axially short design is also advantageous for the greatest possible axial proximity of the radial feed wheel to a rotational bearing of the drive shaft.

In order to be able to fluidically adjust the setting structure, the setting structure is coupled to a piston or itself directly forms a piston which the control fluid can be applied to. In embodiments in which the setting structure itself forms the piston, such a piston can be formed in one piece with the setting structure or can be formed separately and joined to the setting structure fixedly. Such embodiments are preferred for the greatest possible compactness and robustness as compared to coupling the setting structure and the piston by means of a gear system, for example an arrangement of rods or a toothed wheel gear system. Embodiments in which the piston is separately produced and fixedly joined to the setting structure are particularly preferred. In all embodiments, the piston can in particular be formed from an elastically flexible material, for example an elastomer or rubber. The piston can in particular be embodied as an annular piston and extend circumferentially at a radial distance around the rotational axis of the drive shaft, preferably also at a radial distance from the outer circumference of the drive shaft. Depending on the installation situation, it can also be advantageous to arrange a plurality of individual pistons, for example three individual pistons, in a distribution around the rotational axis instead of one annular piston.

In developments, the coolant pump comprises a pressure limiter for limiting the pressure of the control fluid which adjusts the setting structure. The pressure limiter is expediently a pressure limiting valve and can in particular be embodied as a reflux valve. If the servo pump comprises a servo pump housing of its own, then arranging the pressure limiter in the servo pump housing contributes to the compactness of the coolant pump and simplifies its assembly.

The coolant pump can comprise a pressure holding means which prevents control fluid from flowing off through the servo pump, for example through unavoidable leaks, when the servo pump is at a stop. The pressure holding means can in particular be provided in combination with an annular slider which encompasses the radial feed wheel on the outer circumference, in order to prevent or at least delay a backflow of the coolant via the radial feed wheel when the combustion engine is at a stop. The pressure holding means ensures that the annular slider is held in the adjusting position which exhibits a maximum axial overlap by means of the control fluid. The coolant thus continues to be held in its cooling cross-sections after the combustion engine has been switched off, such that the combustion engine cools down more slowly after it has been switched off. The pressure holding means can expediently be embodied as a holding valve and in simple preferred embodiments as a reflux valve. If the servo pump comprises a servo pump housing of its own, the pressure holding means can be arranged in the servo pump housing, which benefits the compactness of the coolant pump and also simplifies its assembly.

The setting structure can conceptually correspond to the setting structures discussed with respect to the prior art. The setting structure can thus for example be embodied as a guide vane structure comprising guide vanes which are arranged over the outer circumference of the radial feed wheel. Such a setting structure can—as is in principle likewise known from the prior art—be axially adjustable relative to the radial feed wheel, such that the axial overlap between the radial feed wheel and the guide vane structure can be varied. Instead or additionally, such guide vanes can also be pivoting guide vanes, in order to be able to alter their engagement in the outflow region, preferably by collectively linking them to a rotationally adjustable ring which can itself form a piston, to which the control fluid can be applied, or can be coupled to such a piston in a way which is suitable for rotationally adjusting it. In alternative embodiments, the setting structure can be an adjustable inlet shutter which is arranged in the inflow region.

In preferred embodiments, the setting structure is formed as an annular slider or guide slider such as are known in terms of their type and discussed at the beginning with respect to the prior art. In embodiments as a guide slider, the setting structure is non-rotationally connected to the radial feed wheel but can be adjusted axially relative to the radial feed wheel, such that it can be adjusted back and forth between the radial feed wheel and an axially opposite wall of the housing. Adjusting the guide slider varies the axial width of the flow channel between the inflow region and the outflow region, which is associated with a variation of the delivery volume of the coolant pump at a given rotational speed of the radial feed wheel, i.e. without a change in the rotational speed.

It is conducive to the compactness of the delivery pump if the setting structure is embodied as an axially adjustable annular slider. Annular sliders can be simply formed and arranged and can be stably embodied and activated in a simple way. The annular slider surrounds the radial feed wheel on the outer circumference in at least one of its different axial adjusting positions and overlaps the radial feed wheel, axially forming an annular gap at least partially, such that a flow transition cross-section which leads from the radial feed wheel into the outflow region can be varied. The annular slider acts as an exit shutter. It is preferably arranged such that it forms an annular gap directly with the radial feed wheel on the outer circumference of the radial feed wheel. Instead, it can however also be arranged slightly downstream of the outer circumference of the radial feed wheel; an arrangement in which it directly encompasses the radial feed wheel in the at least partially overlapping position is however favorable to the effectiveness of the coolant pump.

In preferred embodiments, the setting structure is axially guided in a guide contact along a guide. The guide contact is preferably a sliding contact. The guide contact preferably exists directly between the setting structure and the guide. It is advantageous for the compactness and stability of the setting structure and by extension the coolant pump if the guide contact is not near to the circumferential surface of the drive shaft but rather radially distanced from it and instead nearer to the outer circumference of the radial feed wheel, as measured radially, than to the rotational axis of the drive shaft and preferably also radially nearer to the outer circumference of the radial feed wheel than is a circumferential surface of the drive shaft which is situated axially level with the guide contact. A guide which is as radially external as possible helps to reduce the design space, since a connecting stay which requires space for the axial adjusting movement does not have to extend, as in the prior art, radially outwards from the circumferential surface of the drive shaft to the setting structure, for example the preferred annular slider. In relation to the servo pump, the guide contact of the setting structure can exhibit a greater radial distance from the rotational axis of the drive shaft than does the outer circumference of the at least one servo pump wheel. If the servo pump comprises two or even more servo pump wheels which are in a delivery engagement with each other, the guide contact of the rotational axis of the drive shaft is preferably arranged radially outside a circle which surrounds the rotational axis of the drive shaft and all the servo pump wheels.

In preferred embodiments, the setting structure surrounds the servo pump. If the setting structure is guided in an axial guide contact, the guide contact is preferably also radially outside the servo pump housing. The servo pump housing can then for example directly form the guide for the setting structure on its outer circumference.

The guide for the setting structure can be formed directly by the housing of the coolant pump or, as already mentioned, directly by the servo pump housing or by both in combination, if the servo pump comprises a servo pump housing of its own. In preferred embodiments, however, a guide sleeve is inserted into the housing of the coolant pump, wherein the inner or preferably outer circumferential surface of the guide sleeve forms the guide. Such a guide sleeve can in particular be slid onto the servo pump housing, i.e. can surround the servo pump housing, if provided. It is conducive to compactness and a reduction in the number of parts if the setting structure is directly in guide contact with the guide sleeve.

The guide contact is preferably achieved by a stay bearing of the setting structure, in that a circumferential surface of the setting structure which radially faces the guide, preferably an internal circumferential surface, comprises axially extending stays and recesses which are alternately consecutive in the circumferential direction, and in that the stays of the setting structure are in sliding guide contact with the guide.

With regard to the choice of materials, it is advantageous if the housing of the coolant pump is formed from a light metal, preferably aluminum or an aluminum-based alloy. The housing can then in particular be cast and, if bearing points or fittings are to be provided, machine-cut or machine-ground at the corresponding locations. The setting structure can likewise be produced from a metal; more preferably, it is formed from a plastic material. It can in particular be a plastic injection-moulded part. The guide mentioned can likewise be produced from plastic, but is then preferably produced from a material which is favorable to the preferred sliding guide contact with the setting structure. More preferably, however, the guide consists of a metallic material and for example likewise consists of a light metal or steel. A setting structure made of plastic and a guide made of steel also result in a particularly favorable, low-friction tribological pairing for a sliding guide contact of the setting structure. The at least one servo pump wheel—or, if there are a plurality of servo pump wheels, one or more or all of these wheels—can be produced from a metallic material or plastic. If the setting structure or a servo pump wheel is produced from plastic, both thermoplasts and duroplasts can be considered for this purpose.

In embodiments in which it can be adjusted along an adjusting axis, preferably along the rotational axis of the drive shaft, the setting structure can be supported in an elastically flexible way parallel to the adjusting axis via holding arms, i.e. by means of elastically deformable holding arms, instead of or in addition to a guide. Although two such holding arms arranged in a distribution around the adjusting axis, preferably in a two-fold rotational symmetry, are sufficient in principle, it is particularly advantageous if three such holding arms are arranged about the adjusting axis in a preferably three-fold rotational symmetry. An arrangement of more than three such holding arms creates a geometric redundancy, such that arranging precisely three elastically deformable holding arms is preferred. The holding arms are preferably formed and arranged in relation to the adjusting axis such that they keep the setting structure centered when it is adjusted in relation to the adjusting axis, preferably in each adjusting position. By means of the holding arms, it is also possible to simultaneously provide a spring means which ensures that the adjusting structure is tensed into a particular adjusting position and can be adjusted from this adjusting position into another adjusting position by means of the pressure of the control fluid. In principle, however, the elastically deformable holding arms can also be provided in addition to another spring means which in such embodiments preferably applies a spring force to the setting structure in the same direction as the holding arms.

In simple embodiments, the coolant pump can be configured to only supply the combustion engine with the coolant for the purpose of cooling. It can however also be configured to additionally supply one or more other units, for example a heat exchanger of a vehicle heater, with the coolant which has been heated by the combustion engine. In such embodiments, it can be a multiple-flow pump comprising a first outflow region for the combustion engine and a second outflow region for the other unit. The two or as applicable even more flows can each be equipped with a setting structure of their own, in the way described, in order to be able to control each of the flows, separately from the other flow in each case, in accordance with requirements. It is however also possible to provide a branch in or downstream of the outflow channel, such that a coolant pump which is for example only a single-flow pump delivers the whole of the coolant and only delivers the coolant to the combustion engine or the one or more other unit(s) to be supplied, downstream of the radial feed wheel, by means of a corresponding valve.

BRIEF DESCRIPTION OF THE DRAWINGS

An example embodiment of the invention is explained below on the basis of figures. Features disclosed by the example embodiment, each individually and in any combination of features, advantageously develop the subjects of the claims and the embodiments explained above. There is shown:

FIG. 11 a coolant pump comprising a filter and a mechanical cleaning means;

FIG. 12 the coolant pump of FIG. 11, in a view onto the filter;

DETAILED DESCRIPTION OF THE PREFERRED EMBODIMENTS

Figure 1:
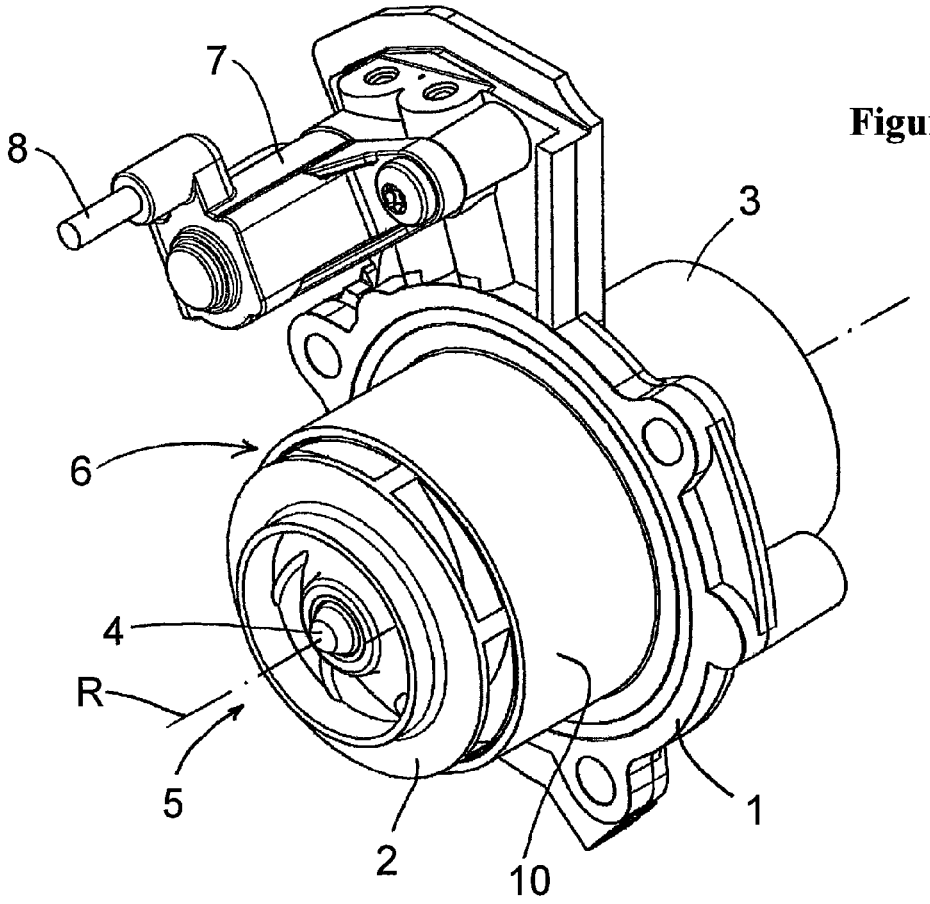
FIG. 1 a coolant pump in a perspective view.

FIG. 1 shows a coolant pump in accordance with the invention which can be used as a coolant pump for a combustion engine, preferably an internal combustion engine of a motor vehicle. It is a coolant pump having a radial design. In a housing 1 of the coolant pump, a radial feed wheel 2 is mounted such that it can be rotated about a rotational axis R. The housing 1 comprises assembling points for assembling it in the cooling cycle of the combustion engine, preferably on the combustion engine. When assembled, the coolant pump is coupled to the combustion engine in order to drive it, i.e. it is rotationally driven by the combustion engine via a suitable gear system, for example a traction drive. A drive wheel 3—for example a belt pulley, as is usual, which could however also be replaced with a sprocket in the case of a chain drive or with a toothed wheel for an optional toothed wheel drive instead of a traction drive—is correspondingly arranged on one drive side of the coolant pump. The drive wheel 3 is arranged coaxially with the radial feed wheel 2 and can thus be rotated about the same rotational axis R. The radial feed wheel 2 is connected, fixed in terms of torque, to the drive wheel 3. The two wheels 2 and 3 are for example each connected, secured against rotation, to a common drive shaft 4 which is rotationally mounted by the housing 1. When the pump is in operation, the radial feed wheel 2 delivers a coolant, preferably a liquid coolant, from a central inflow region 5—the suction side of the pump—into an outflow region 6 which extends around the radial feed wheel 2 on the outer circumference. The radial feed wheel 2 is connected on the suction side to a coolant reservoir via the inflow region 5 and on the pressure side to the combustion engine which is to be supplied with the coolant or to one or more other consumers, for example a heater, via the outflow region 6.

In order to be able to adapt the coolant flow delivered by the radial feed wheel 2 to the requirements of the combustion engine or another optional consumer, the coolant pump can be adjusted in terms of its delivery flow. The delivery flow is adjusted by varying the flow geometry, for example by varying the flow cross-section in the transition from the radial feed wheel 2 into the outflow region 6 which—as is known from radial pumps—is formed by an annular channel or partial annular channel of a part of the housing 1 which has been removed and is not shown in FIG. 1. The annular or partial annular channel extends completely around the radial feed wheel 2 over 360°, or at least some of its circumference, on the outer circumference of the radial feed wheel 2. A setting structure 10 which is formed as an annular slider such as preferably a split ring slider and can be adjusted axially back and forth into different adjusting positions relative to the housing 1 and the radial feed wheel 2 serves to vary the flow geometry. The setting structure 10 together with the radial feed wheel 2 directly forms an annular gap which encompasses the radial feed wheel 2; it thus acts as a split ring slider. The setting structure 10 can be adjusted back and forth between a first axial adjusting position and a second axial adjusting position. In FIG. 1, it assumes the first adjusting position in which the transition cross-section from the radial feed wheel 2 into the outflow region 6 is at a maximum. In the second adjusting position, this transition cross-section is at a minimum. In the first adjusting position, the setting structure 10 for example exposes the radial feed wheel 2 over the whole of its effective axial delivery width. In the second adjusting position, it overlaps the effective delivery width of the radial feed wheel 2—as is preferred but merely by way of example—completely. It is therefore possible by means of the setting structure 10 to adjust between a minimum delivery volume, which for example corresponds to a zero delivery, and a maximum delivery volume. The setting structure 10 can preferably be adjusted into any intermediate position between the first and second adjusting positions and set to the desired adjusting position, i.e. held in position.

In order to be able to adjust the delivery volume automatically, the coolant pump comprises an actuator means comprising a control valve 7 which is formed—as is preferred but only by way of example—as an electromagnetically acting valve. Electrical energy and control signals can be fed to the control valve 7 via a port 8. The control valve 7 can in particular be connected to a controller of the combustion engine, for example an engine controller in the case of a drive motor of a motor vehicle, or a controller for a vehicle heater via the port 8.

The setting structure 10 can be fluidically adjusted by means of a control fluid which is formed by the coolant to be delivered. For this purpose, the setting structure 10 is coupled in the housing 1 to a piston which a pressure of the control fluid is applied to, controlled by the control valve 7. A control signal can be fed to the control valve 7 via the port 8. The control signal can be generated in accordance with a measured temperature, in particular a temperature measured in the cooling circuit, such as for example a coolant temperature. A temperature sensor can thus be arranged at a representative location in the cooling circuit, preferably at each of a plurality of representative locations, and its sensor output signal is fed to the controller which forms the control variable for the control valve 7 from the sensor signal(s).

Figure 2:
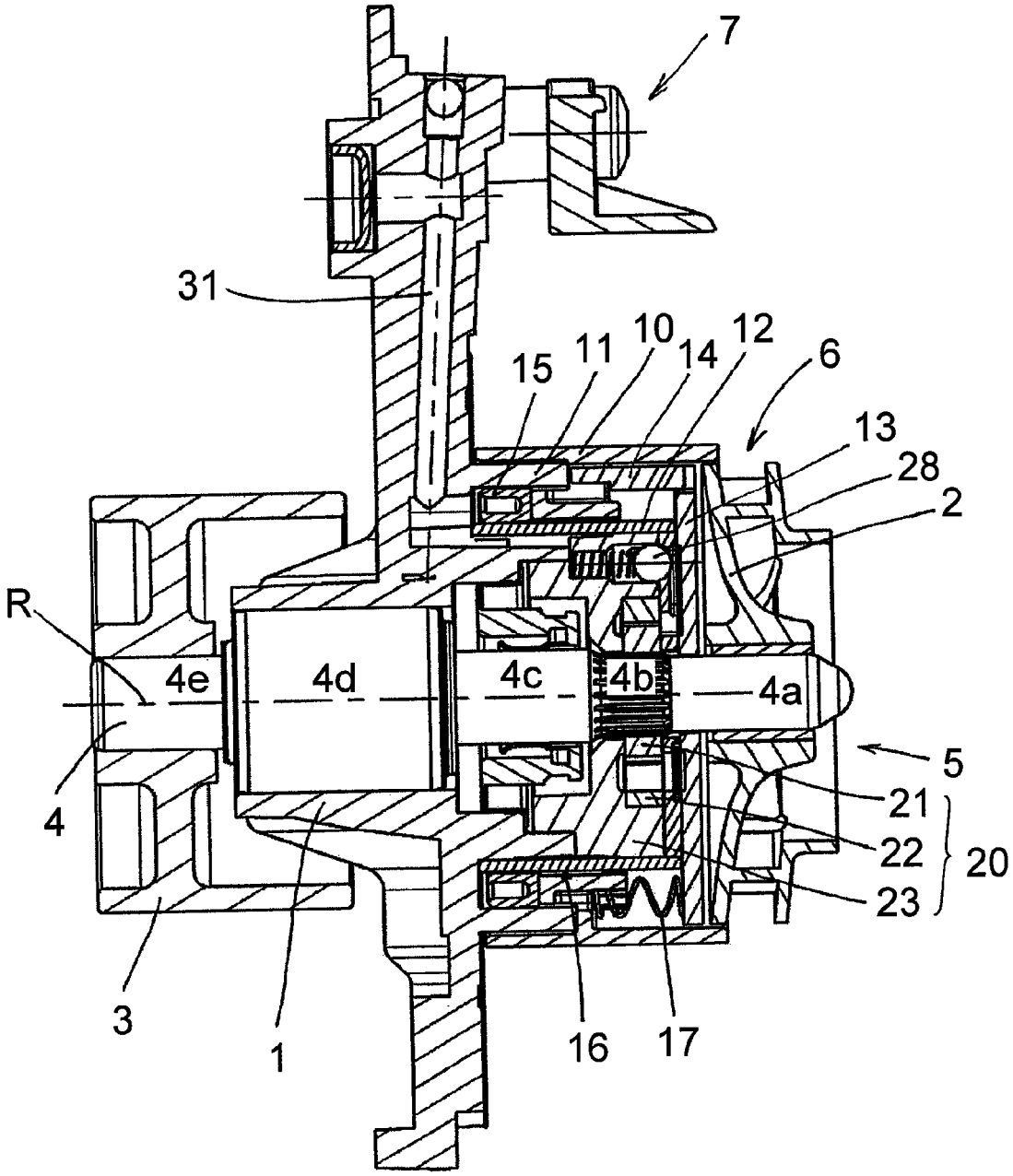
FIG. 2 the coolant pump in a longitudinal section.

FIG. 2 shows the coolant pump in a longitudinal section. The drive shaft 4 is sub-divided into functional axial portions 4*a* to 4*e* in the representation and is mounted in and by the housing 1 such that it can be rotated in the shaft portion 4*d* by means of a roll bearing. The radial feed wheel 2 is connected, secured against rotation, to the drive shaft 4 in a front end portion 4*a*. The drive wheel 3 is arranged in a rear shaft portion 4*e* which faces axially away from the shaft portion 4*a*, behind the rotational bearing portion 4*d* when viewed from the radial feed wheel 2, where it is connected, secured against rotation, to the shaft 4. Because the shaft 4 is rotationally mounted in a shaft portion axially between the support for the radial feed wheel 2 and the support for the drive wheel 3, an axially short distance between the rotational bearing of the shaft 4 and the radial feed wheel 2 is maintained and a bending moment which may occur during delivery action and is to be absorbed in the portion 4*d* of the rotational bearing of the drive shaft 4 is reduced.

In order to generate the control fluid pressure required for adjusting the setting structure 10, the coolant pump comprises an additional pump 20 which is referred to in the following as the servo pump 20 in order to distinguish it conceptually from the actual coolant pump. The servo pump 20 is a displacement pump and is embodied—as is preferred but nonetheless only by way of example—as an internal toothed wheel pump. It comprises an internal wheel 21 which is connected, secured against rotation, to the shaft 4 and provided with an external toothing, and an internally toothed external wheel 22 which surrounds the internal wheel 21, which are in a delivery engagement, i.e. a toothed engagement, with each other in which they periodically form delivery cells which increase in size and decrease in size again circumferentially around the rotational axis R when the shaft 4 is rotationally driven. The control fluid—in this case, the coolant—is suctioned by the delivery cells which increase in size, in the region in which the cells increase in size, i.e. the low-pressure side of the servo pump 20. The control fluid is expelled again at an increased pressure in the region in which the cells decrease in size, i.e. the high-pressure side of the servo pump 20. The servo pump 20 is connected to the control valve 7 on its high-pressure side via a pressure channel 31.

The control fluid region which extends from the exit of the servo pump 20 to the control valve 7, i.e. which includes the pressure channel 31, forms the high-pressure side of the servo pump 20. The pressure of the control fluid on the high-pressure side is set using the control valve 7. On this high-pressure side, the control fluid acts on a piston 15 which is guided such that it can be axially moved in the housing 1 of the coolant pump and is coupled to the setting structure 10 such that the setting structure 10 is shifted towards the adjusting position which exhibits the maximum axial overlap of the radial feed wheel 2 when a corresponding control fluid pressure is applied to the piston 15. The piston 15 is connected, axially fixed, to the setting structure 10—as is preferred—such that the setting structure 10 is simply slaved in the axial movement of the piston 15. A spring force is applied to the setting structure 10 in the opposite axial direction by a spring means comprising springs 17 which are arranged in a uniform distribution around the rotational axis R. The spring force which restores the setting structure 10 towards the minimum-overlap adjusting position which it assumes in FIG. 2 thus acts counter to the control fluid pressure acting on the piston 15.

The control valve 7 can for example be a manifold valve which can be switched between different switching positions and blocks off the high-pressure side of the servo pump 20 in a first switching position and short-circuits the high-pressure side of the servo pump 20 to the coolant circuit in a second switching position and preferably connects it to the pressure side of the coolant pump for this purpose. The servo pump 20 is expediently configured such that even when the combustion engine is idling, the control fluid pressure generated by the servo pump 20 is sufficient to adjust the setting structure 10 into the maximum-overlap adjusting position when the control valve 7 is situated in the first switching position, i.e. the blocking position. If, as is preferred, the maximum-overlap adjusting position corresponds to a complete overlap, the radial feed wheel 2 delivers practically no coolant. This enables the combustion engine to be heated quickly when it is started from cold. The power consumption of the coolant pump is also reduced.

If another unit—for example a motor vehicle heater, if the combustion engine is the drive motor of a vehicle—is also to be supplied with the coolant delivered by the radial feed wheel 2, a diversion to such an additional unit can be arranged downstream of the feed wheel 2, and another control valve can be provided in order to optionally guide the coolant to the combustion engine or to the other unit, which also includes the scenario in which the coolant can be guided via such a control valve to both the combustion engine and the other unit simultaneously. In accordance with the requirements of an optional additional unit, it can therefore also be advantageous if the setting structure 10 does not axially overlap the radial feed wheel 2 completely on the outer circumference in the maximum-overlap adjusting position but rather only over an axial partial portion.

In simple embodiments, the control valve 7 can exhibit in total only the two switching positions mentioned and also always assume one of these switching positions. In such simple embodiments, the setting structure 10 can be triggered such that the setting structure 10 can only assume one of the two extreme positions respectively, i.e. either the maximum-overlap adjusting position or the minimum-overlap adjusting position. In one development, the control valve 7 can be configured to switch back and forth between the two switching positions quickly enough that the setting structure 10 can also be set to any adjusting position axially between the two extreme positions. In yet other developments, the control valve 7 can be configured to set the pressure of the control fluid continuously to a particular value and so set the setting structure 10 to a particular position or to any desired position between the maximum-overlap adjusting position and the minimum-overlap adjusting position, in accordance with the equilibrium of force between the control fluid pressure and the restoring spring force.

A pressure holding means 28, which prevents the control fluid from being able to flow back into the servo pump 20, is arranged between the servo pump 20 and the control valve 7. In a blocking position, the pressure holding means 28 blocks a flow cross-section against a backflow to the servo pump 20 but allows an outward flow towards the control valve 7. It only opens when the pressure of the control fluid at an upstream inlet of the pressure holding means 28 near to the servo pump 20 exceeds the pressure of the control fluid at a downstream outlet of the pressure holding means 28 near to the control valve 7. A spring force into the blocking position is applied to the pressure holding means 28, i.e. it assumes the blocking position at equal pressure. The spring force acting in the blocking position is determined such that the pressure holding means 28 opens towards the control valve 7 at least when the combustion engine is idling and the pressure acting on the piston 15 corresponds to the ambient pressure. The pressure holding means 28 is embodied—as is preferred but only by way of example—as a reflux valve.

When the control valve 7 is blocking, it is possible due to the pressure holding means 28 for the setting structure 10 to be held in the maximum-overlap adjusting position for a comparatively long period of time after the combustion engine has been switched off, since the control fluid is prevented from flowing back via the servo pump 20. If, as is preferred, the setting structure 10 closes and largely seals the transition cross-section on the outer circumference of the radial feed wheel 2 in this adjusting position, the coolant can be held back upstream of the radial feed wheel 2 for longer—in accordance with the strength of seal on the transition cross-section—than would be the case if the pressure were quickly relieved on the high-pressure side of the servo pump 20. The combustion engine can cool down more slowly after it has been switched off, and the cooling process can be consolidated.

The servo pump 20 and the pressure holding means 28, if the latter is provided, are preferably configured such that the pressure generated by the servo pump 20 when the combustion engine is idling is sufficient to adjust the setting structure 10 into the maximum-overlap adjusting position. By correspondingly triggering the control valve 7, this pressure can be either held or reduced and the position of the setting structure 10 can thus be set in accordance with requirements, even when the combustion engine is idling. This preferably also applies to any other operational state of the combustion engine as long as the control fluid pressure generated by the servo pump 20 is sufficient to overcome the restoring spring force which acts on the setting structure 10 towards the minimum-overlap position.

Figure 4:
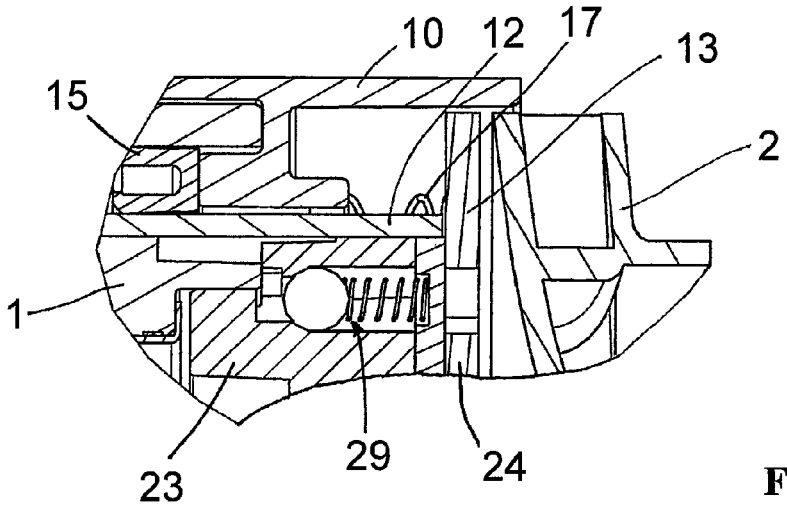
FIG. 4 a pressure limiter of the coolant pump.

The control fluid pressure is limited to a maximum value by means of a pressure limiter 29 which is shown in FIG. 4, such that the control fluid pressure cannot exceed this value even at high rotational speeds and a correspondingly high delivery volume of the servo pump 20. Limiting the control fluid pressure limits the force with which the setting structure 10 can press against an axial abutment in the maximum-overlap adjusting position to a maximum value which follows from the control fluid pressure and the effective pressure surface of the piston 15. An inlet of the pressure limiter 29 is connected to the space in which the control fluid is applied to the piston 15. An outlet of the pressure limiter 29 guides the control fluid back into the main flow of the coolant which is delivered by the radial feed wheel 2. The pressure limiter 29 is formed—as is preferred but only by way of example—as a reflux valve. The pressure limiter 29 is arranged offset with respect to the pressure holding means 28 in the circumferential direction around the rotary axis R. The longitudinal section shown in FIG. 4 is correspondingly offset in the circumferential direction with respect to the longitudinal section in FIGS. 2 and 3.

The servo pump wheels 21 and 22 are accommodated in a servo pump housing 23 of their own. The servo pump housing 23 rotatably mounts the external wheel 22 over its outer circumference in a sliding contact. Accommodating the servo pump wheels 21 and 22 in their own servo pump housing 23 facilitates assembling the coolant pump, in that a pre-assembled servo pump 20 can be installed. The servo pump housing 23 is arranged in the housing 1 of the coolant pump, as is preferred, within the annular setting structure 10. The pressure holding means 28 and the pressure limiter 29 are likewise arranged in the servo pump housing 23.

Figure 3:
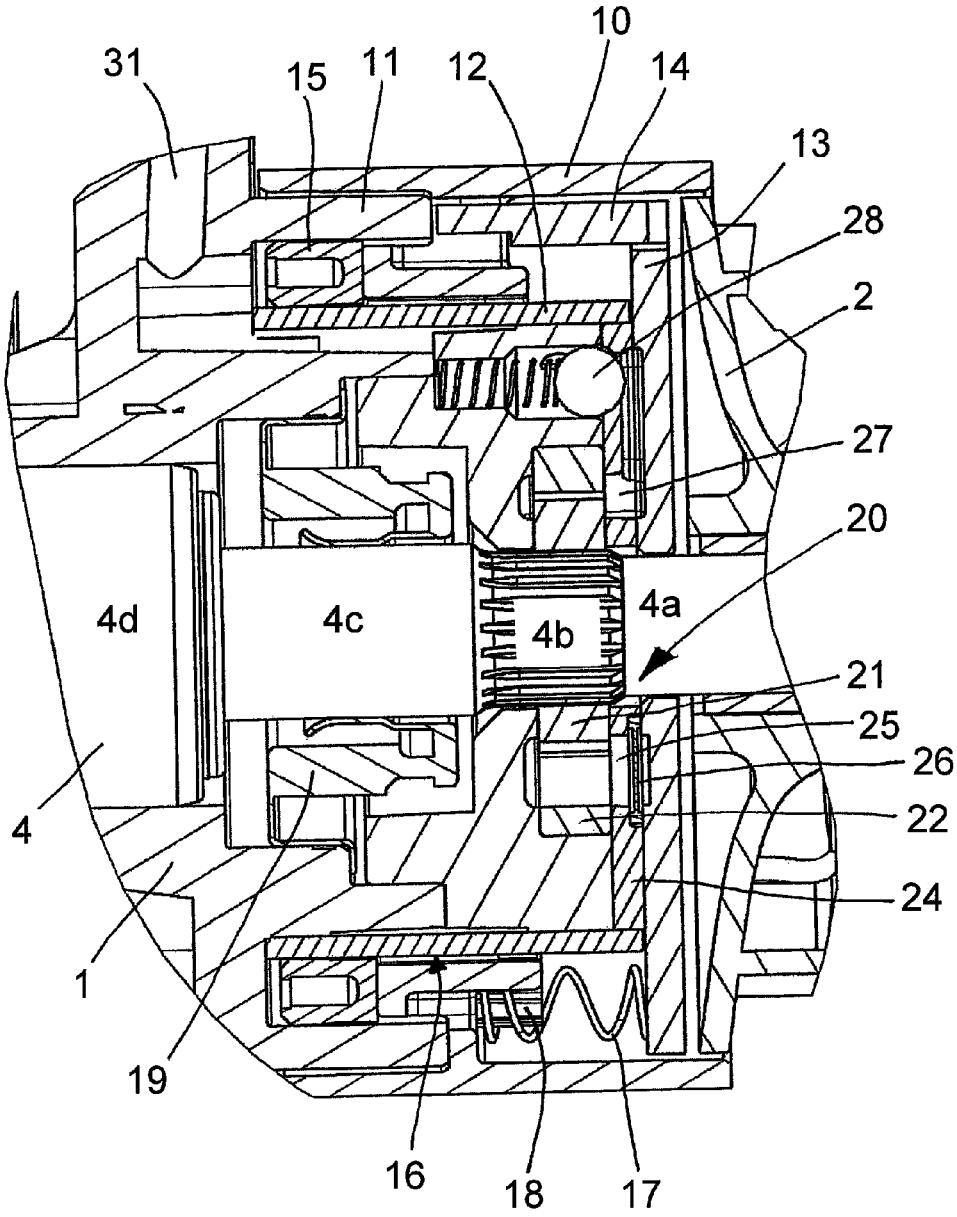
FIG. 3 a central region of the coolant pump, in the longitudinal section.

FIG. 3 shows an enlarged representation of the central region of the coolant pump, in the same longitudinal section as FIG. 2. The centrally arranged servo pump housing 23 is covered by a lid 13 on its axially facing side which faces the radial feed wheel 2. The lid 13 also simultaneously covers the housing 1 of the coolant pump on the side in question. A covering plate 24 is also arranged axially between the servo pump housing 23 and the lid 13 and directly overlaps the servo pump housing 23, wherein the inlet 25 and outlet 27 of the servo pump 20 are formed in the covering plate 24. A filter 26, for example a filter sieve, which holds back dirt particles is arranged in the inlet 25 in the covering plate 24. When the drive shaft 4 rotates, the servo pump 20 suctions coolant in through the inlet 25 from a location within the centrifugal force field, preferably on or near to the outer circumference of the radial feed wheel 2, and expels the coolant at an increased pressure through the outlet 27 as a control fluid. The outlet 27 is connected to the pressure channel 31 via the pressure holding means 28, and the pressure channel 31 is connected to the rear side of the piston 15 which faces away from the radial feed wheel 2. The pressure holding means 28 assumes the blocking position in FIG. 3. The servo pump 20 is at a stop, or if the control valve 7 is blocking, the pump speed has just been reduced.

The servo pump 20 is arranged in the shaft portion 4*b* which axially connects to the shaft portion 4*a*. A shaft seal 19, for example in the form of a sliding ring seal or a lip seal, which seals off the housing 1 is arranged in the shaft portion 4*c* between the servo pump housing 23 and the shaft portion 4*d* which forms the rotational bearing. As can also be seen not least from FIG. 3, the servo pump 20 which is embodied as a rotary pump is advantageously axially narrow, which enables the radial feed wheel 2 to be axially arranged particularly near to the rotational bearing formed in the shaft portion 4*d*. Because of the embodiment as an internal toothed wheel pump, this axial distance can be kept particularly small.

The setting structure 10 is axially guided along a guide 12 in a sliding guide contact. The guide 12 is a sleeve which is inserted into the housing 1—as is preferred, but only by way of example, a steel sleeve. The guide 12 surrounds the servo pump housing 23 and is for example slid directly over the servo pump housing 23. The guide 12 is thus supported inwards on the servo pump housing 23. It is also supported on the housing 1 by also being slid, preferably pressed, in the housing 1 onto a free circumferential surface of the housing 1. The housing 1 is preferably produced from an aluminum material and can in particular be cast from aluminum or an aluminum-based alloy.

The setting structure 10 can in particular be a plastic structure, for example an injection-moulded part made of a thermoplast. The piston 15 is expediently formed from an elastomer or from natural rubber. The piston 15 is accommodated, such that it can be moved axially back and forth, in an annular cylinder space. The annular cylinder space is limited on the outside by an internal circumferential surface of the housing 1 and on the inside by the guide 12. Limiting the annular cylinder space using metal surfaces is favorable to the respective tribological pairing with the piston 15. As already mentioned, the control fluid is applied to a free side of the piston 15. The piston 15 is arranged at an axial end of the setting structure 10, which faces away from the radial feed wheel 2 as is preferred, and can be connected to the setting structure 10, in particular fixedly, for example in a material fit. In principle, however, the piston 15 can also be in a pressure contact only with the setting structure 10 in the direction in which the control fluid is applied to it. As mentioned, a plurality of springs 17 which are arranged in a distribution around the rotational axis R act counter to the pressure of the control fluid and are respectively supported at one end on the lid 13 and at the other end on a spring seating 18 which is formed on the setting structure 10. The springs 17 are for example embodied as helical pressure springs. They are arranged in an annular space which is limited radially on the inside by the guide 12 and radially on the outside by the setting structure 10.

In its guide contact with the guide 12, the setting structure 10 is supported on the guide 12 by means of a stay bearing which is formed by axially extending stays 16. The stays 16 are formed on an internal circumference of the setting structure 10 which radially faces the guide 12.

Figure 5:
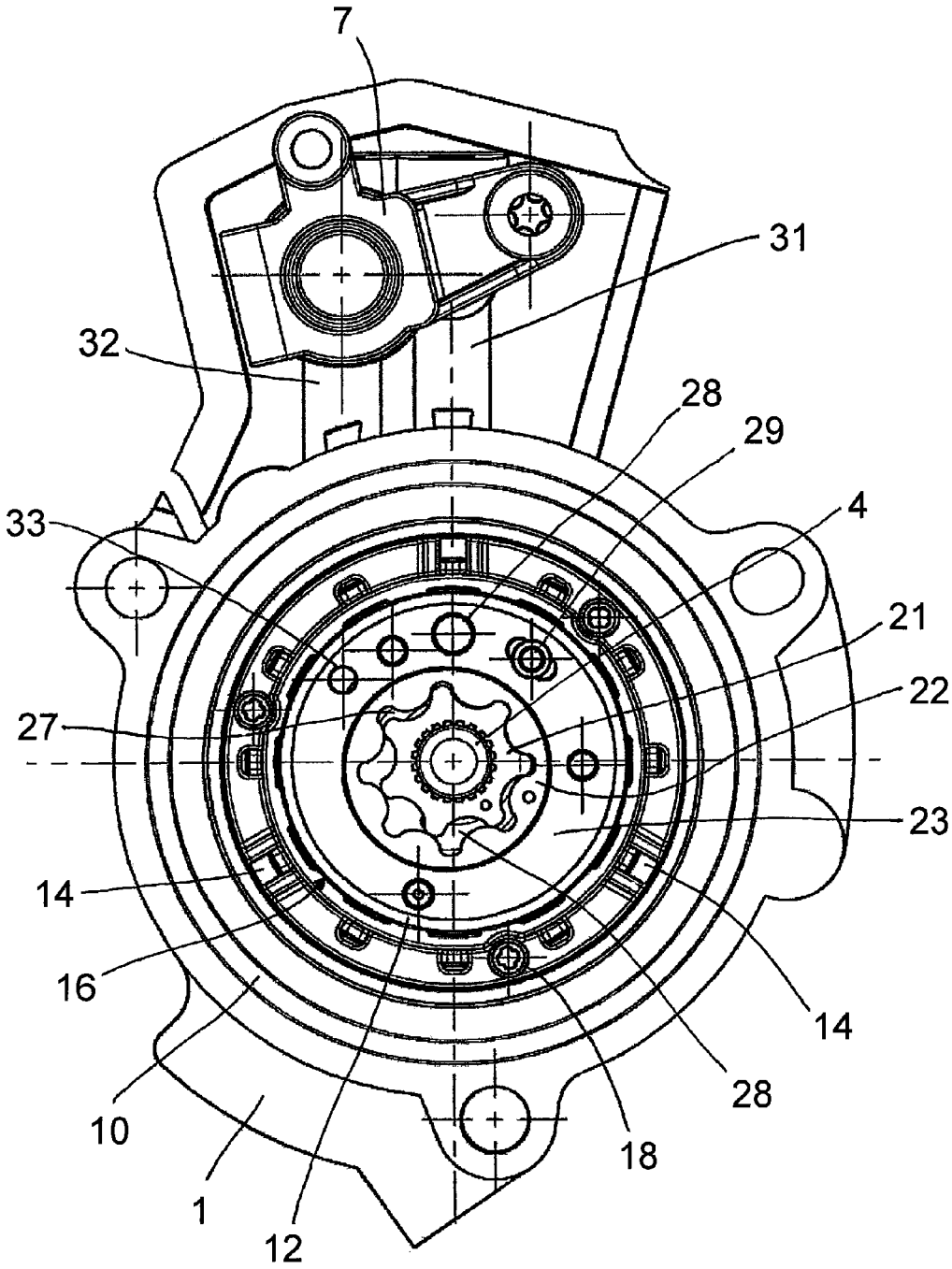
FIG. 5 the coolant pump in a first cross-section.

FIG. 5 shows the coolant pump in a cross-section, axially level with the servo pump wheels 21 and 22. The shaft 4, the internal wheel 21 which is arranged, secured against rotation, on the shaft 4, the external wheel 22 which is in delivery engagement with the internal wheel 21, the pump housing 23 and the guide 12 which surrounds the pump housing 23 can be seen radially from the inside outwards. The accommodating space which is formed in the servo pump housing 23 in order to form the pressure limiter 29, and a connecting channel which is connected to the outlet 27 of the servo pump 20 via the covering plate 24 and the lid 13 (FIG. 3) and to the pressure channel 31 leading to the control valve 7 and in which the pressure holding means 28 is formed, can also be seen. Another connecting channel 33 is connected to a relieving channel 32. The relieving channel 32 is connected to the control valve 7. The relieving channel 32 leads from the control valve 7 back into the coolant cycle via the connecting channel 33. In one of its switching positions, the control valve 7 connects the pressure channel 31 to the relieving channel 32, such that only a comparatively low pressure is applied to the piston 15 (FIG. 3) and the setting structure 10 is held in the minimum-overlap adjusting position shown in FIGS. 2 and 3 by the force of the springs 17.

The axial stays 16 which are formed on the internal circumference of the setting structure 10 and are released by recesses on the internal circumference which are respectively adjacent in the circumferential direction, wherein said stays ensure a clean axial guide for the setting structure 10, can also be seen in FIG. 5. The setting structure 10 is guided, secured against rotation, relative to the housing 1 of the coolant pump by means of rod-shaped rotational blocks 14 which protrude into corresponding complementary guides on the setting structure 10. One of the rotational blocks 14 can also be seen in FIG. 3. The rotational blocks 14 project axially from the rear side of the housing lid 13. Lastly, the support locations on the setting structure 10 for the springs 17, i.e. the spring seating's 18, can also be seen in FIG. 5.

Figure 6:
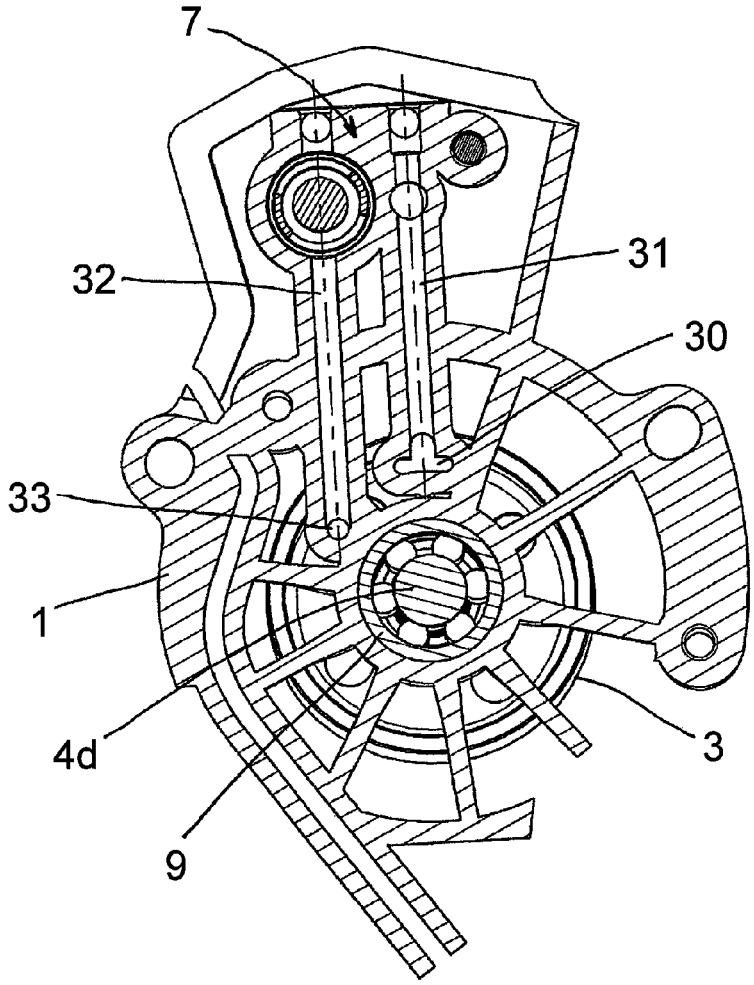
FIG. 6 the coolant pump in a second cross-section.

FIG. 6 shows the coolant pump again in another cross-section, axially level with the rotational bearing formed in the shaft portion 4*d*. The cross-sectional plane extends along the pressure channel 31 and relieving channel 32. It should also be added with respect to the rotational bearing that the rotational bearing is formed by at least two bearing grooves which are axially spaced from each other and roll bodies which are arranged in the bearing grooves around the rotational axis R and by a bearing sleeve 9 which encloses the roll bodies on the outside. The bearing grooves are formed directly on the outer circumference of the drive shaft 4. The bearing sleeve 9 is pressed into the housing 1. The drive shaft 4 and the roll bearing and/or plurality of roll bearings which are axially spaced from each other and the bearing sleeve 9 together form a design unit which is inserted into the housing 1 when the coolant pump is assembled.

Figure 7:
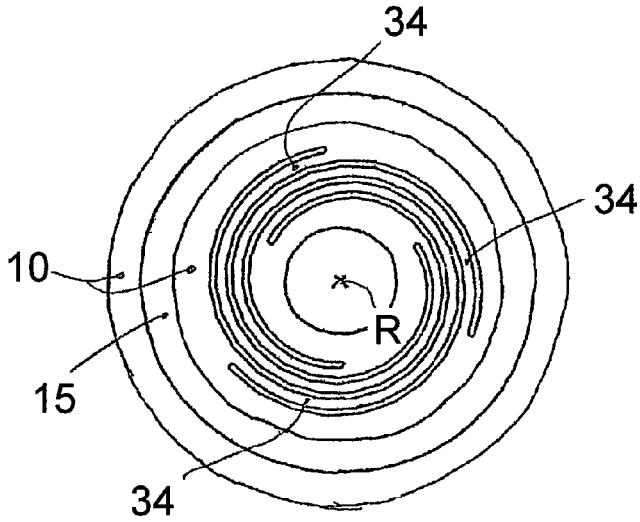
FIG. 7 a modified setting structure.

FIG. 7 shows a setting structure 10 which has been modified in terms of its bearing as compared to the setting structure 10 used in the coolant pump depicted. The modified setting structure 10 is shown individually, not assembled, in a view onto its rear side which faces away from the radial feed wheel 2 when it is installed. The piston 15 is arranged on the rear side. Elastic holding arms 34 are arranged on the rear side of the setting structure 10 in a uniform distribution around the rotational axis R and are for example formed—as is preferred—in a spiral around the rotational axis R. The holding arms 34 can be formed by correspondingly formed breaches, for example slot-shaped breaches, on the rear side of the setting structure 10. The setting structure 10 can comprise a base on its rear side in order to form the holding arms 34. Alternatively, the holding arms 34 can also be formed near to the outer circumference of the setting structure 10, in order to enable an arrangement in accordance with the setting structure 10 of the coolant pump shown in FIGS. 1 to 6. In such an embodiment which is modified again, the holding arms 34 would be formed in the outer region on the rear side of the setting structure 10, preferably still radially outside the piston 15. The holding arms 34 can be formed directly on the setting structure 10 or can be formed separately and joined to the setting structure 10. The holding arms 34 can replace the springs 17 if they are connected, axially fixed, to the housing 1.

Figure 10:
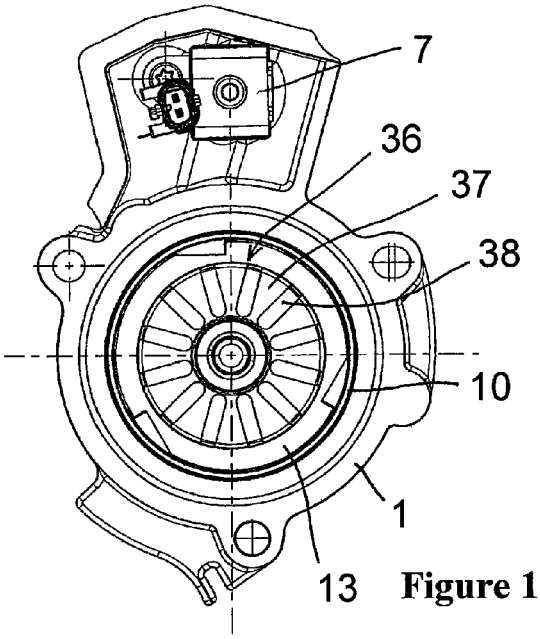
FIG. 10 the coolant pump of FIG. 8, in a view onto the filter.
Figure 9:
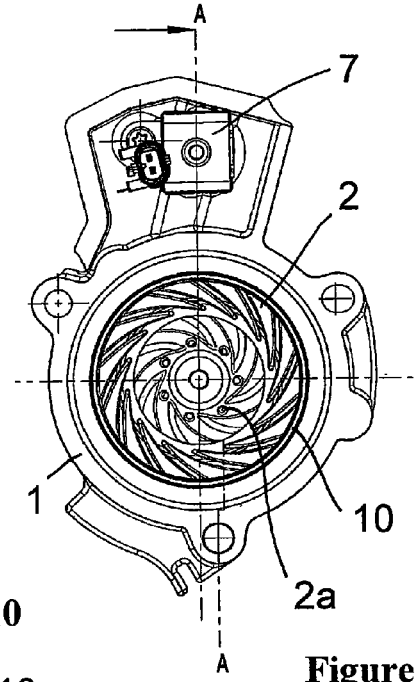
FIG. 9 the coolant pump of FIG. 8, in a view onto a radial feed wheel.
Figure 8:
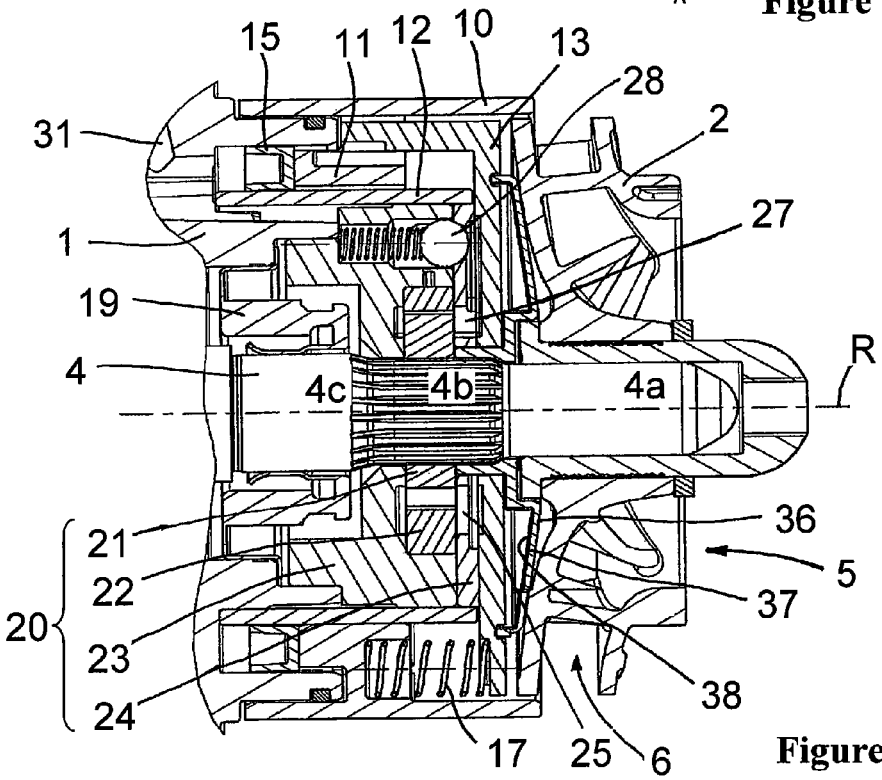
FIG. 8 a coolant pump comprising a rotating filter.

FIGS. 8, 9 and 10 show a longitudinal section and two front views of a coolant pump comprising a modified filter for cleaning the coolant which flows to the servo pump 20. Except for the filter, which is provided with the reference sign 36, the coolant pump corresponds to the coolant pump described above, such that reference is made to the statements made in this respect, and the same reference signs are used as in FIGS. 1 to 7.

The filter 36 replaces the filter 26 (FIG. 3). Unlike the filter 26 which is fixedly connected to the servo pump housing 23, the filter 36 is connected, such that it cannot be rotated, to the drive shaft 4, such that it is slaved in the rotational movement of the drive shaft 4. When the filter 36 is rotated, dirt particles held by the filter 36 of the servo pump 20 are accelerated outwards away from the rotational axis R and thus also away from the filter 36 by the centrifugal force, and the filter 36 is thus cleaned. The filter 36 is slid onto the drive shaft 4, into a positive-fit engagement with the shaft portion 4*b*, thus providing the non-rotational connection. It is also arranged—as is preferred but only by way of example—such that it at least substantially cannot be moved axially relative to the drive shaft 4.

The filter 36 comprises a holder 37 and filter material 38 which is held by the holder 37. The holder 37 is non-rotationally connected to the shaft 4 in a central holder region and forms a seal against the servo pump housing 23 over its radially outer circumferential edge, such that coolant suctioned by the servo pump 20 cannot bypass the filter 36 but rather can only flow through the filter material 38 to the servo pump inlet 25. For a peripheral seal, the holder 37 could press against an axially facing surface of the servo pump housing 23, for example with an elasticity force, over the circumferential edge and could for example comprise an elastic sealing lip over its circumferential edge. In the example embodiment, however, a recess—for example, a groove—is formed circumferentially around the rotational axis R on the axially facing side of the servo pump housing 23, wherein the peripheral circumferential edge of the holder 37 engages with said recess. The circumferential edge and the recess together form a labyrinth seal.

The holder 37 comprises a holder region which is permeable to the coolant, wherein the filter material 38 which the fluid can flow through covers the holder region or can be arranged in the holder region. In order to form the permeable holder region, the holder 37 can comprise holder stays which extend outwards from the central holder region in the shape of a star, as in the example embodiment and as can be seen in the front view onto the filter 36 in FIG. 10. Apertures which remain between the holder stays extend to or near to the peripheral circumferential edge of the holder 37, as is preferred, and together form the permeable holder region.

The filter 36 is arranged in a gap axially between the radial feed wheel 2 and the servo pump housing 23. The coolant delivered by the radial feed wheel 2 flows through the radial feed wheel 2 to the filter 36 and through the filter 36 to the inlet 25 of the servo pump 20. The radial feed wheel 2 is correspondingly permeable. It comprises—as is preferred but only by way of example—a plurality of apertures 2*a*, which can be seen in FIG. 9, in a distribution around the rotational axis R in a central region near to the rotational axis R.

FIGS. 11 and 12 show a coolant pump which—like the coolant pump of FIGS. 1 to 7—comprises a filter 40 for cleaning the coolant which flows to the servo pump 20, wherein the filter 40 is stationary, i.e. cannot be rotated relative to the housing 1. Unlike the coolant pump of FIGS. 1 to 7, however, the filter 40 is assigned a cleaning means 41 which mechanically cleans the filter when the drive shaft 4 rotates. This coolant pump also otherwise corresponds to that of FIGS. 1 to 7.

The cleaning means 41 is formed by a scraper which is connected, such that it cannot be rotated, to the drive shaft 4 and arranged upstream, i.e. in front of the filter 40, when viewed in the flow direction to the servo pump 20. The cleaning means 41 is slid onto the drive shaft 4, into a positive-fit engagement with the shaft portion 4*b*, thus providing the non-rotational connection. When the drive shaft 4 rotates, the cleaning means 41 sweeps over the front side of the filter 40 which faces it and scrapes off dirt particles during this relative rotation. The cleaning means 41 is formed—as is preferred but only by way of example—as an impeller comprising a plurality of projecting vanes 42, as can be seen in FIG. 12 in the front view onto the arrangement consisting of the filter 40 and the cleaning means 41. Each of the vanes 42 can act as a scraper. In modifications, the filter 40 can be mechanically cleaned using a cleaning means which acts as a brush instead of the scraping cleaning means 41 or a combination of scraping and brushing, for example by either forming the vanes 42 as brushes or by forming at least one of the vanes 42 as a brush and at least one of the other vanes 42 as a scraper.

Figure 13:
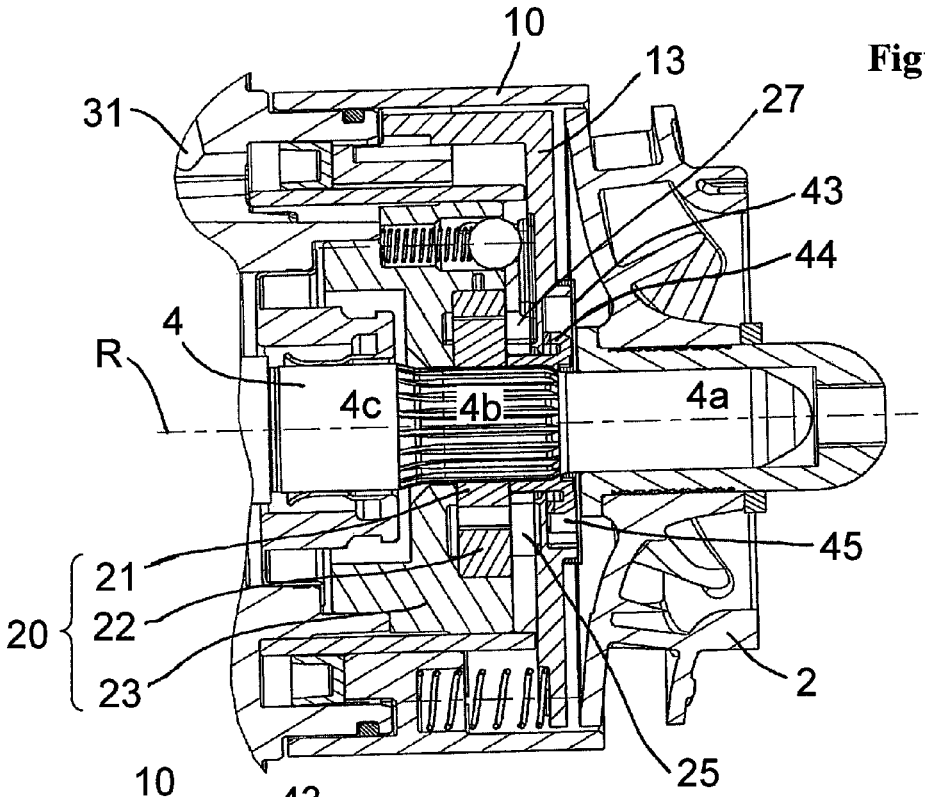
FIG. 13 a coolant pump comprising a filter and a fluidic cleaning means.
Figure 14:
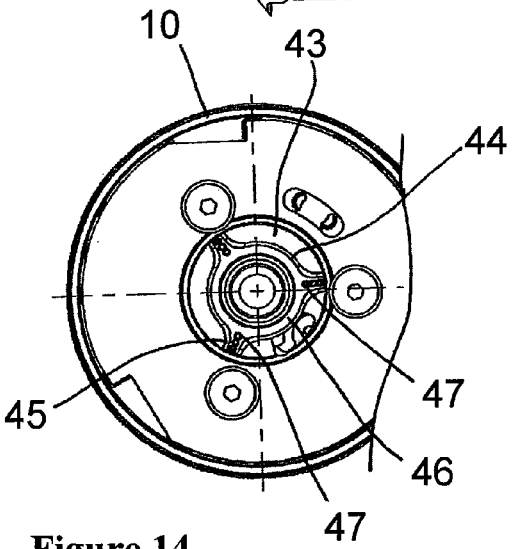
FIG. 14 the coolant pump of FIG. 13, in a view onto the filter.
Figure 15:
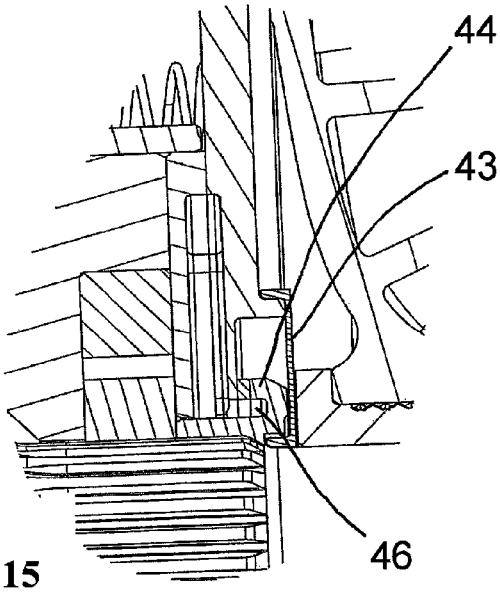
FIG. 15 the filter and the cleaning means in a detailed representation.

FIGS. 13 to 15 show a longitudinal section, a front view and a detail of a coolant pump comprising a filter 43 for cleaning the coolant which flows to the servo pump 20 and comprising a cleaning means 44 for cleaning the filter 43. Aside from the combination of the filter 43 and the cleaning means 44, the coolant pump corresponds to that of FIGS. 1 to 7, such that reference is made to the statements made in this respect, and the same reference signs as in FIGS. 1 to 7 are again used. The filter 43 is arranged such that it is stationary, in particular such that it cannot be rotated, relative to the housing 1, and the cleaning means 44 is non-rotationally connected to the drive shaft 4. In this respect, the filter-cleaning combination 43, 44 corresponds to the combination 40, 41 of FIGS. 11 and 12. Unlike the combination 40, 41, however, the cleaning means 44 cleans the filter 43 fluidically, by rinsing the filter 43—counter to the outward flowing direction which leads to the servo pump inlet 25—with coolant which has been suctioned by the servo pump 20 and cleaned by the filter 43.

The cleaning means 44 cleans the filter 43 by such reverse-flow rinsing in two ways. One of the ways is that control fluid from the high-pressure side of the servo pump 20 is applied to the rear side of the filter 43 via the cleaning means 44. The other way is that the cleaning means 44 sweeps over the rear side of the filter 43 when it is rotated, wherein an axially narrow gap remains between the rear side of the filter and the facing front side of the cleaning means 44, i.e. contact-based mechanical cleaning is not performed, but rather fluidic cleaning based on hydrodynamically building up pressure. In simplified embodiments, it is also possible to solely realize only one of these two ways of reverse-flow rinsing.

The fluidically acting cleaning means 44 is arranged downstream of the filter 43—in the example, directly behind the filter 43—and acts on its rear side. The cleaning means 44 comprises a fluid feed 46 (FIGS. 15 and 16) which is connected to the high-pressure side of the servo pump 20 and sealed off against the low-pressure side of the pump 20 by means of a rotational seal and via which control fluid from the high-pressure side of the pump 20 is applied to the rear side of the filter 43. The fluid feed 46 is—as is preferred but only by way of example—a distributor channel which is formed on the rear side of the cleaning means 44 in the central region of the cleaning means 44. The cleaning means 44 comprises a plurality of vanes 45 projecting from the central region and is permeable to the control fluid in the region of the vanes 45. The vanes 45 are connected to the fluid feed 46 which guides the control fluid to the vanes 45, through which the control fluid reaches the rear side of the filter. The cleaning means 44 is only permeable in the region of the vanes, such that the control fluid is respectively applied to the rear side of the filter in the course of the relative rotational movement only in the surface regions which are currently overlapped by the vanes 45, while the coolant can flow freely between the vanes from the cleaning means to the servo pump 20. The vanes 45 each comprise at least one passage—in the example, a plurality of passages 47 each—which provide their permeability. The cleaning means 44 can be formed as a hollow body in order to provide the fluid feed 46 and the permeability towards the filter 43. More preferably, however, the feed 46 is formed as an open recess on the rear side of the cleaning means 44, and the passages 47 are formed to be continuous from the rear side to the front side of the vanes 45, as in the example. It is merely necessary to ensure a seal in order that the high-pressure side of the pump 20 is not short-circuited to the low-pressure side of the pump 20 via the cleaning means 44. This can be ensured by sufficiently tight gaps between the servo pump housing 23—in the example embodiment, the lid 13—and the rear side of the cleaning means 44.

When the cleaning means 44 is rotated relative to the filter 43, the vanes 45 generate a pressure burden locally on the rear side of the filter 43, which presses filtered coolant out of the space in which the cleaning means 44 is arranged, counter to the outward flowing direction, back through the filter 43. This hydrodynamic rinsing effect does not require the fluid to flow through the cleaning means 44. The effect can be amplified if the front sides of the vanes 45 which face the filter 43 each comprise a pocket-shaped recess which is limited in and counter to the rotational direction by sealing stays of the respective vane 45.

With respect to the cleaning means which comprise an impeller, such as for example the cleaning means 41 and 43 (FIGS. 11 to 15), it may be noted that if only a plurality of vanes are mentioned, the respective impeller can also be replaced with an impeller comprising only one vane, for example only one of the vanes 41 or 45.

Figure 16:
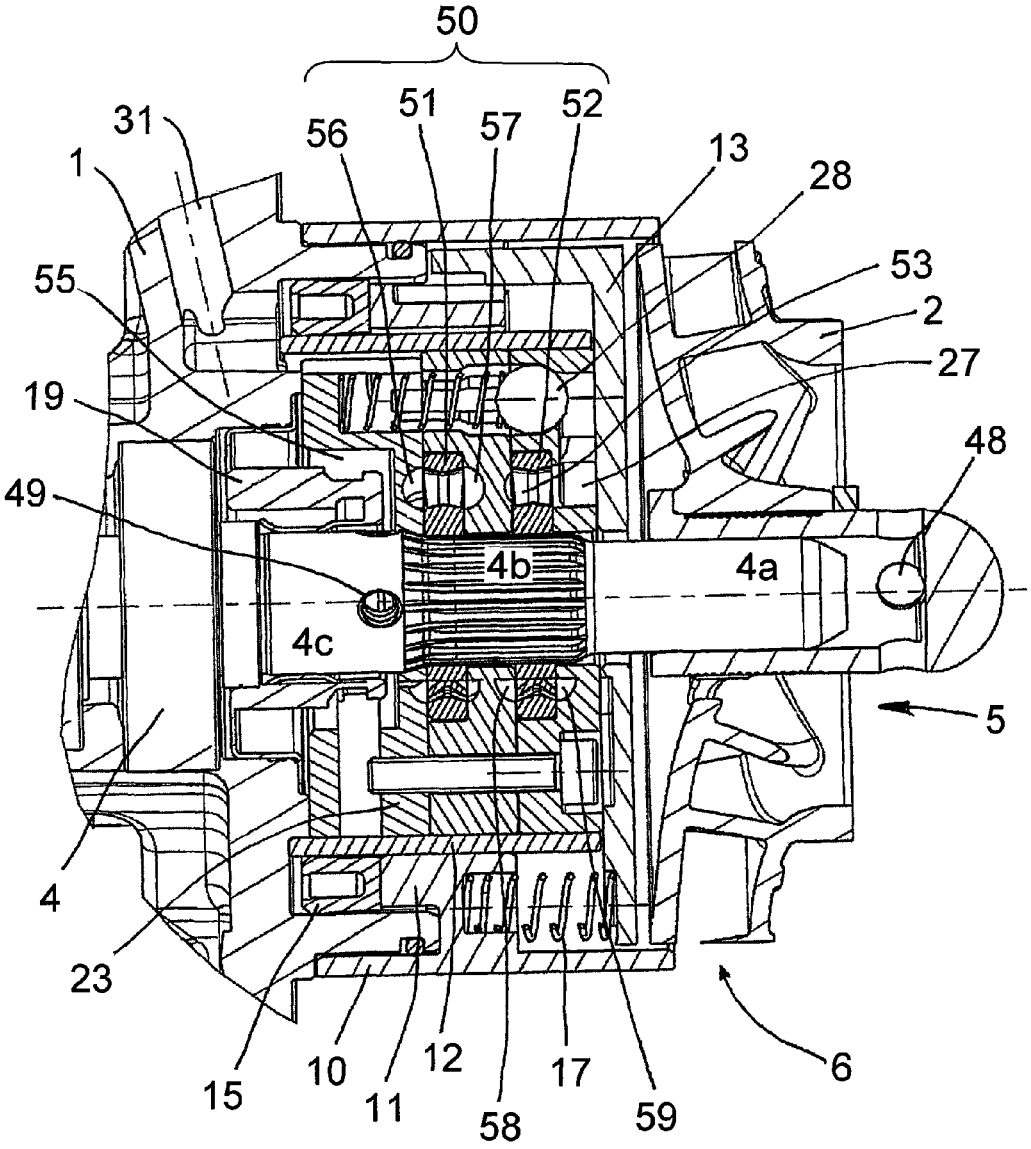
FIG. 16 a coolant pump comprising a side channel pump as the servo pump.
Figure 17:
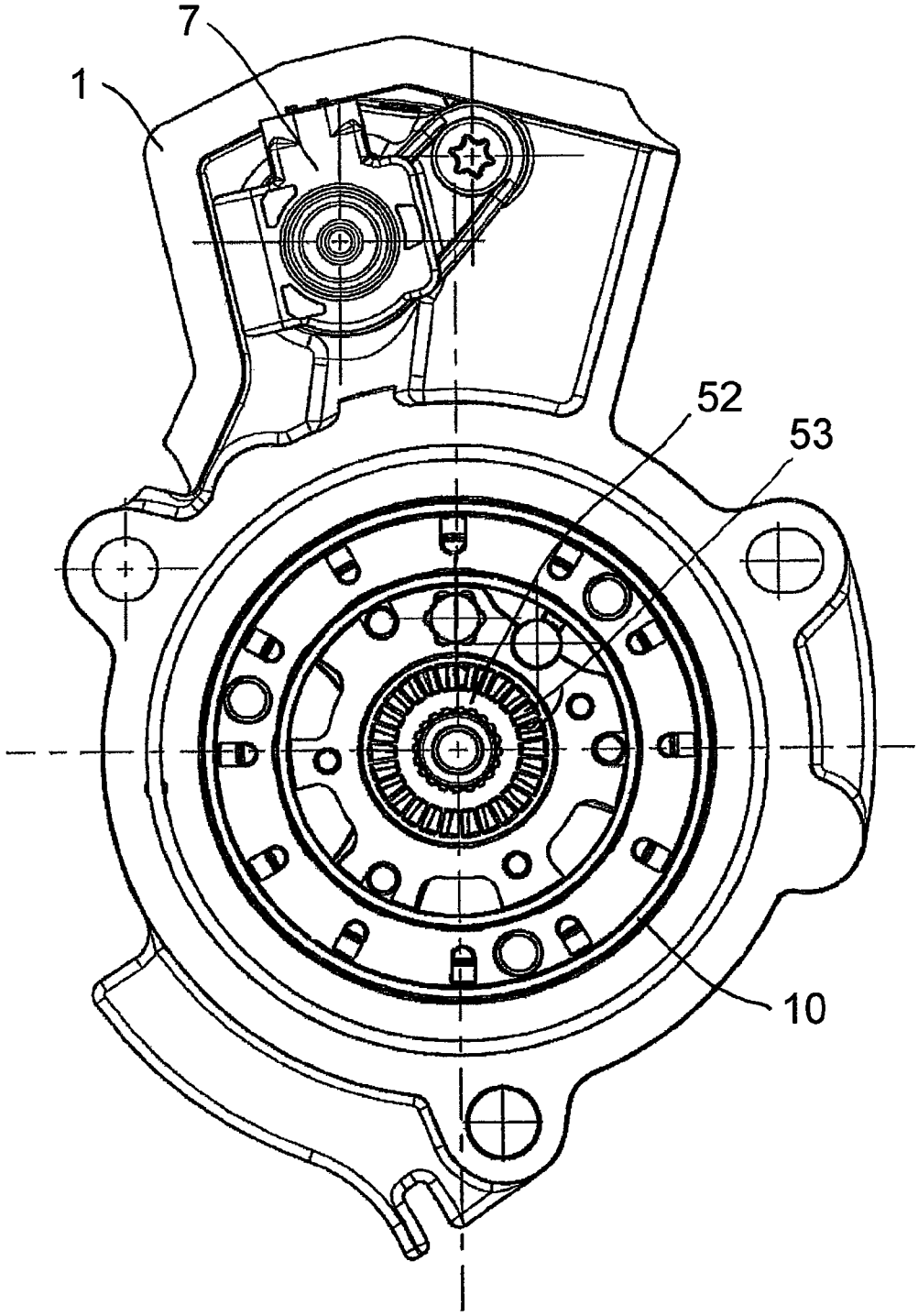
FIG. 17 the coolant pump of FIG. 16, in a view onto the servo pump.

FIGS. 16 and 17 show a coolant pump which comprises a servo pump 50 formed as a side channel pump, instead of the servo pump 20. The servo pump 50 is a multi-stage pump, preferably a two-stage pump, wherein the pump stages are connected in series in order to achieve a high delivery pressure. The coolant pump also differs from the other example embodiments in the way in which the coolant is fed to the servo pump 50.

In the centrifugal force field generated by the radial feed wheel 2, the coolant is diverted from the main flow as early as the inflow region 5 of the coolant pump, centrally via a port 48 which is formed there, and guided through the drive shaft 4 to the servo pump 50. The port 48 is formed by at least one inlet opening which feeds onto the outer circumference of the drive shaft 4. The port 48 is preferably formed collectively by a plurality of inlet openings which are spaced from each other in the circumferential direction. The coolant suctioned by the servo pump 50 flows through the port 53 into and axially through the drive shaft 4 to an outlet 49 which likewise feeds onto the outer circumference of the drive shaft 4, and flows through the outlet 49 into a fluid space 55 which is connected to an inlet of the servo pump 50 which cannot be seen in the figures. The outlet 49 can also comprise a plurality of such outlet openings. Due to the diversion being central in the centrifugal force field, additionally aided by the fact that the port 48 feeds into the centrifugal force field on an outer circumferential surface which extends at least substantially axially, only coolant which has been depleted of dirt particles due to the effect of the centrifugal force reaches the servo pump 50.

The servo pump 50 comprises a first servo pump wheel 51 and a second servo pump wheel 52. The servo pump wheels 51 and 52 are themselves identical, which is expedient but not necessarily required. The pump wheels 51 and 52 are cell wheels, each comprising a central region, a circumferential external ring and an annular region which is situated between the central region and the external ring and is sub-divided into axially permeable delivery cells 53 by cell stays, as can be seen from an overview of FIGS. 16 and 17, wherein the delivery cells 53 are separated from each other in the circumferential direction by the cell stays. The servo pump wheels 51 and 52 can also be formed as impellers which are open on the outside, by omitting an external ring which surrounds the delivery cells 53 radially on the outside.

Side channels are formed alongside the servo pump wheels 51 and 52 in the servo pump housing 23 and each extend in the circumferential direction and radially level with the delivery cells 53 over an angle of less than 360°. Thus, a first side channel 56 and a second side channel 57 each extend alongside the first pump wheel 51, one on the left and the other on the right alongside it, and a third side channel 58 and a fourth side channel 59 each extend alongside the second pump wheel 52, one on the left and the other on the right alongside the pump wheel 52. Each of the side channels 56 to 59 is formed in the housing 23 as a recess which is axially open towards the delivery cells 53 of the assigned pump wheel 51 or 52, such that the fluid—in this case, the coolant—can flow back and forth between the delivery cells 53 and the side channels 56, 57 and 58, 59 of the respective pump wheel 51 or 52, in order to achieve the increase in pressure which is known from side channel pumps and is based on impulse transmission in multiple transitions between the delivery cells 53 and the respective side channel. The first side channel 56 is connected to the fluid space 55 via the inlet of the servo pump 50. The second side channel 57 is connected to the third side channel 58, and the fourth side channel is connected to the outlet 28 of the servo pump 50. When rotationally driven, the servo pump suctions the coolant from the fluid space 55 into the side channel 56 via the inlet of the servo pump 50 and thus into the first pump stage formed by the pump wheel 51 and the side channels 56 and 57. The suctioned coolant is delivered at an increased pressure through an internal outlet of the second side channel 57 to an internal inlet of the third side channel 58 and discharged in the second pump stage formed by the pump wheel 52 and the side channels 58 and 59, with a further increase in pressure, through the servo pump outlet 28 towards the pressure holding means 28.

The example embodiment of FIGS. 16 and 17 combines a side channel pump with cleaning the coolant using a centrifugal force. This way of cleaning the coolant can instead also be combined with any other type of servo pump in accordance with the invention, for example the servo pump 20 of the other example embodiments. Instead of cleaning exclusively on the basis of a centrifugal force as in the last example embodiment, any of the arrangements which clean using filter material and consist of a filter or a filter and an assigned cleaning means can equally be combined with a single-stage or multi-stage side channel pump, to mention only some of the variations which are possible within the context of the invention.

REFERENCE SIGNS 1 housing
2 radial feed wheel
2*a* port, aperture
3 drive wheel
4 drive shaft
4*a*-*e* shaft portions
5 inflow region
6 outflow region
7 control valve
8 port
9 bearing sleeve
10 setting structure, annular slider
11 housing support
12 guide, guide sleeve
13 lid
14 rotational block
15 piston, seal
16 guide stay
17 restoring spring
18 spring seating, spring guide
19 seal
20 servo pump
21 servo pump wheel, internal wheel
22 servo pump wheel, external wheel
23 servo pump housing
24 covering plate
25 inlet
26 filter
27 outlet
28 pressure holding means
29 pressure limiter
30 connecting channel
31 pressure channel
32 relieving channel
33 connecting channel
34 holding arm
35 -
36 filter
37 holder
38 filter material
39 -
40 filter
41 cleaning means, scraper
42 vane
43 filter
44 fluidic cleaning means
45 vane
46 fluid feed
47 fluid aperture
48 port, inlet
49 outlet
50 servo pump
51 servo pump wheel
52 servo pump wheel
53 delivery cells
54 -
55 fluid space
56 side channel
57 side channel
58 side channel
59 side channel
R rotational axis

The invention claimed is:

1. A coolant pump for delivering a coolant in a coolant circuit of a combustion engine, said coolant pump comprising:

a) a housing;

b) a drive shaft, which is rotatably mounted by the housing, for being rotationally driven by the combustion engine;

c) a radial feed wheel which can be rotationally driven by the drive shaft, for delivering the coolant from a radially internal inflow region into a radially more external outflow region;

d) a setting structure which can be adjusted into different positions relative to the housing by means of a control fluid, for adjusting a flow geometry, wherein a flow cross-section or flow profile on the flow path of the coolant comprises the inflow region, the radial feed wheel and the outflow region, and wherein said flow geometry influences the delivery volume of the pump at a given rotational speed;

e) a control valve for setting a pressure or a volume flow of the control fluid formed by the coolant, wherein said pressure or said volume flow determines the position of the setting structure; and in addition to the radial feed wheel, a servo pump for delivering the control fluid to the control valve, wherein g) the servo pump is a rotary pump which can be rotationally driven by the drive shaft and comprises at least one servo pump wheel which can be rotationally driven.

2. The coolant pump according to claim 1, wherein the servo pump wheel is arranged coaxially with the drive shaft and is non-rotationally connected to the drive shaft.

3. The coolant pump according to claim 1, wherein the servo pump is (i) a single-stage or multi-stage side channel pump or (ii) a centrifugal pump or (iii) a toothed wheel pump or (iv) an internal toothed wheel pump or (v) a vane cell pump' or (vi) a pendulum slider pump or (vii) a roller cell pump.

4. The coolant pump according to claim 1, wherein the servo pump is connected to the coolant circuit, and an inlet of the servo pump is connected to the coolant circuit within the housing of the coolant pump.

5. The coolant pump according to claim 1, wherein the setting structure is coupled to a piston or itself forms a piston to which the control fluid can be applied to in order to adjust the setting structure, and a pressure holding means for maintaining the pressure of the control fluid between the servo pump and the control valve, which pressure is applied to the piston, or a pressure limiter for limiting the pressure of the control fluid which is applied to the piston is/are provided.

6. The coolant pump according to claim 1, wherein the servo pump wheel is arranged in a servo pump housing.

7. The coolant pump according to claim 6, wherein a pressure holding means for maintaining the pressure of the control fluid is provided between the servo pump and the control valve, which pressure is applied to the piston, or a pressure limiter for limiting the pressure of the control fluid which is applied to the piston is provided, and the pressure holding means or the pressure limiter is/are arranged in the servo pump housing.

8. The coolant pump according to claim 6, wherein a lid of the housing of the coolant pump also forms .a lid of the servo pump housing.

9. The coolant pump according to claim 1, wherein the setting structure is an annular slider or guide slider which can be axially adjusted into the different positions relative to the radial feed wheel, wherein (i) the setting structure, when embodied as an annular slider, axially overlaps the radial feed wheel at least partially on an outer circumference in at least one of the positions such that a flow transition cross-section which leads from the radial feed wheel into the outflow region can be varied, (ii) and the setting structure, when embodied as a guide slider, is non-rotationally connected to the radial feed wheel and arranged axially between the radial feed wheel and a covering structure which is fixedly connected to the housing of the coolant pump, such that axially adjusting the guide slider changes the axial width of a flow cross-section which is limited by the covering structure and the guide slider.

10. The coolant pump according to claim 1, wherein the setting structure is axially guided in a guide contact along a guide, and the guide contact exhibits a radial distance from a rotational axis of the drive shaft.

11. The coolant pump according to claim 1, wherein the setting structure is axially guided along a guide in a guide contact near to the outer circumference of the setting structure, and a guide sleeve which is inserted into the housing of the coolant pump forms the guide.

12. The coolant pump according to claim 1, wherein the setting structure is axially guided in a guide contact along a guide, and the setting structure alternately comprises axially extending stays and recesses in the circumferential direction on a circumferential surface which radially faces the guide, and the stays of the setting structure are in a sliding contact with the guide.

13. The coolant pump according to claim 10, wherein the setting structure is coupled to a piston or itself forms a piston to which the control fluid can be applied to in order to adjust the setting structure and further comprising at least one of the following features:

(i) the housing of the coolant pump is produced from aluminum or an aluminum-based alloy;

(ii) the setting structure is produced from plastic;

(iii) the guide is produced from steel and is preferably a steel sleeve;

(iv) the piston is an elastomer piston or a rubber piston.

14. The coolant pump according to claim 1, wherein the servo pump is connected to the coolant circuit and a port is provided within the centrifugal force field of the radial feed wheel and connected to an inlet of the servo pump.

15. The coolant pump according to claim 1, wherein the servo pump is connected to the coolant circuit, and a filter is provided upstream of the servo pump wheel in order to keep particles carried by the coolant away from the servo pump wheel.

16. The coolant pump according to claim 1 further comprising at least one of the following features:

(i) a filter is connected to the drive shaft in a way which transmits torque, such that when the drive shaft is rotationally moved, particles situated on or in the filter are removed from the filter by centrifugal force;

(ii) a cleaning means is assigned to the filter, and one of the cleaning means and the filter is connected to the drive shaft in a way which transmits torque, and can be rotated relative to the other of the cleaning means and the filter, wherein the cleaning means sweeps over the filter during the relative rotational movement, in order to mechanically or fluidically clean it;

(iii) a cleaning means is assigned to the filter, and control fluid which is delivered by the servo pump can be applied to the rear side of the filter by means of the cleaning means, in order to rinse the filter.

17. The coolant pump according to claim 1, wherein the setting structure can be adjusted along an adjusting axis and is mounted by means of at least two elastically deformable holding arms which are arranged in a distribution around the adjusting axis of the setting structure, and the holding arms are formed and arranged in relation to the adjusting axis such that they keep the setting structure centered in relation to the adjusting axis when the setting structure is adjusted.

18. The coolant pump according to claim 1, wherein the control valve is coupled to a controller and the controller is coupled to a temperature sensor, a rotational speed sensor, a load sensor, a throughflow sensor, a position sensor or a range sensor which detects the temperature or the mass throughflow or volume throughflow of the coolant or a rotational speed or load of the combustion engine or the position of the setting structure or a distance travelled by the setting structure when adjusted as compared to a reference position of the setting structure and feeds a corresponding sensor signal to the controller, and the controller controls the control valve in accordance with the sensor signal.

19. The coolant pump according to claim 1, wherein the radial feed wheel is connected non-rotationally to the drive shaft.

20. The coolant pump according to claim 4, wherein the inlet of the servo pump is connected to the coolant circuit within the centrifugal force field of the radial feed wheel or downstream of the radial feed wheel.

21. The coolant pump according to claim 5, wherein the piston is an annular piston.

22. The coolant pump according to claim 6, wherein the servo pump housing is arranged in the housing of the coolant pump.

23. The coolant pump according to claim 9, wherein the setting structure is embodied as an annular slider and surrounds the radial feed wheel, forming an annular gap around the entire outer circumference of the radial feed wheel.

24. The coolant pump according to claim 10, wherein the radial distance is greater than half the radius of the outer circumference of the radial feed wheel or the radius of the outer circumference of the servo pump wheel.

25. The coolant pump according to claim 10, wherein the servo pump wheel is arranged in a servo pump housing and the guide surrounds the servo pump housing .

26. The coolant pump according to claim 13, wherein the setting structure is produced from a thermoplast and is a plastic injection-moulded structure.

27. The coolant pump according to claim 14, wherein the port is provided in or upstream of the radial feed wheel.

28. The coolant pump according to claim 14, wherein the port is connected to the inlet of the servo pump through the radial feed wheel or the drive shaft.

29. The coolant pump according to claim 15, wherein the filter is provided in or on the housing of the coolant pump.

30. The coolant pump according to claim 7, wherein a lid of the housing of the coolant pump also forms a lid of the servo pump housing.

* * * * *

UNITED STATES PATENT AND TRADEMARK OFFICE

CERTIFICATE OF CORRECTION

PATENT NO. : 9,080,573 B2
APPLICATION NO. : 13/396806
DATED : July 14, 2015
INVENTOR(S) : Claus Welte and Uwe Meinig It is certified that error appears in the above-identified patent and that said Letters Patent is hereby corrected as shown below:

On the Title Page, insert Item -- (30), Foreign Application Priority Data,

Feb. 15, 2011 (DE).....10 2011 004 172.9 --

Signed and Sealed this
Eighth Day of March, 2016

Michelle K. Lee

Michelle K. Lee
*Director of the United States Patent and Trademark Office*